US006890432B1

(12) United States Patent
Witz et al.

(10) Patent No.: US 6,890,432 B1
(45) Date of Patent: May 10, 2005

(54) MAGNETIC FUEL TREATMENT APPARATUS FOR ATTACHMENT TO A FUEL LINE

(75) Inventors: John T. Witz, Barrington, IL (US); Albert F. Ditzig, Hoffman Estates, IL (US)

(73) Assignee: DFE II, LLC, Chicago, IL (US)

( * ) Notice: Subject to any disclaimer, the term of this patent is extended or adjusted under 35 U.S.C. 154(b) by 0 days.

(21) Appl. No.: 10/946,495

(22) Filed: Sep. 21, 2004

(51) Int. Cl.[7] ..... F02M 27/04; F02M 33/00
(52) U.S. Cl. ..... 210/222; 123/538
(58) Field of Search ..... 210/222, 223, 210/695; 123/536, 538; 335/302

(56) References Cited

U.S. PATENT DOCUMENTS

| | | | |
|---|---|---|---|
| 4,572,145 | A | 2/1986 | Mitchell |
| 4,601,823 | A | 7/1986 | Beck |
| 4,611,615 | A | 9/1986 | Petrovic |
| 4,659,479 | A | 4/1987 | Stickler |
| 4,711,271 | A | 12/1987 | Weisenberger |
| 4,716,024 | A | 12/1987 | Peru |
| 4,734,202 | A | 3/1988 | Mach |
| 4,755,288 | A | 7/1988 | Mitchell |
| 4,761,228 | A | 8/1988 | Weisenberger |
| 4,808,306 | A | 2/1989 | Mitchell |
| 4,933,151 | A | 6/1990 | Song |
| 4,935,133 | A | 6/1990 | Hirama |
| 4,946,590 | A | 8/1990 | Hertzog |

(Continued)

OTHER PUBLICATIONS

Mundimex, Inc. (USA), 8801 S.W. 192–nd St., Miami, Fl. 33157, website, www.mundi.com/aboutmundi.html Sep. 21, 2004 entitled: About Mundimex (2 pages) Second article entitled: "Why The Magnetizer?" (2 pages), undated.

Uni–Cell website: www.myunicell.com Aug. 31, 2004 entitled: "Improve Your Vehicle's Fuel Efficiency" (2 pages) second article entitled: "Additional Information" (2 pages), undated.

EnergyCel website: www.feg.bz/install.htm Sep. 21, 2004 entitled: Checklist, Assembly, Typical Car Installation, Truck and Fleet Installations (5 pages) Article from Greater Rulsa Reporter Newspapers Oct. 2002 entitled: Energy Cell Makes Vehicles More Fuel Efficient and Safer (4 pages).

EnergyCel website: www.feg.bz.how.htm Sep. 21, 2004 entitled: EnergyCel Tehory (1 page).

EnergyCel website: www.feg.bz/benefit.htm Sep. 21 2004 entitled: Product Benefits (4 pages).

*Primary Examiner*—David A Reifsnyder
(74) *Attorney, Agent, or Firm*—Meroni & Meroni, P.C.; Christopher J. Scott; Charles F. Meroni, Jr.

(57) ABSTRACT

The present invention provides a fuel treatment apparatus for magnetically treating fuel flowing through a fuel conduit. The fuel treatment apparatus essentially comprises an upper magnet assembly, a lower magnet assembly, and a fastening assembly. The magnet assemblies each comprise a magnet positioning cradle, a magnet, and a magnet cover plate. Each cradle comprises a pair of seat flanges upon which the magnets seat. The cover plates maintain the magnets in seated engagement within the cradles and a uniform magnetic field is directed orthogonal to the planes in which the seat flanges lie. Each cradle further comprises a conduit-receiving groove. When the magnet assemblies are fastened to one another via the fastening assembly, the conduit-receiving grooves cooperatively form conduit-receiving apertures. The typically linear fuel conduit is receivable through the conduit-receiving apertures and thus the fuel treatment apparatus is designed to magnetically treat fuel flowing through the fuel conduit.

36 Claims, 11 Drawing Sheets

U.S. PATENT DOCUMENTS 4,956,084 A 9/1990 Stevens
4,999,106 A 3/1991 Schindler
5,024,271 A 6/1991 Meihua
5,024,759 A 6/1991 McGrath
5,030,344 A 7/1991 Ambrose
5,037,546 A 8/1991 Janczak
5,044,347 A 9/1991 Ullrich
5,059,743 A 10/1991 Sakuma
5,063,368 A 11/1991 Ettehadieh
5,069,190 A 12/1991 Richards
5,076,246 A 12/1991 Onyszczuk
5,078,870 A 1/1992 Carpenter
5,124,045 A 6/1992 Janczak
5,127,385 A 7/1992 Dalupin
5,129,382 A 7/1992 Stamps, Sr.
5,130,032 A 7/1992 Sartori
5,171,487 A 12/1992 Hudz
5,227,683 A 7/1993 Clair
5,236,670 A 8/1993 Iwata
5,238,558 A 8/1993 Curtis
5,243,946 A 9/1993 Dalupan
5,254,247 A 10/1993 Kashani
5,269,915 A 12/1993 Clair
5,271,834 A 12/1993 Mondiny
5,307,779 A 5/1994 Wood
5,320,751 A 6/1994 Burns
5,329,911 A 7/1994 Jeong
5,348,050 A 9/1994 Ashton
5,359,979 A 11/1994 Anfinson
5,364,536 A 11/1994 Mercier
5,366,623 A 11/1994 Clair
5,408,498 A 4/1995 Yoshida
5,411,143 A 5/1995 Greene
5,454,943 A 10/1995 Ashton
5,460,718 A 10/1995 Weck
5,487,370 A 1/1996 Miyazaki
5,500,121 A 3/1996 Thornton
5,520,158 A 5/1996 Williamson
5,533,490 A 7/1996 Pascall
5,536,401 A 7/1996 Burns
5,589,065 A 12/1996 Bogatin
5,664,546 A 9/1997 De La Torre Barreiro
RE35,689 E 12/1997 Kulish
5,716,520 A 2/1998 Mason
5,783,074 A 7/1998 Stanley
5,804,067 A 9/1998 McDonald
5,882,514 A 3/1999 Fletcher
5,943,998 A 8/1999 Brown
5,992,398 A 11/1999 Ho
6,041,763 A 3/2000 Akyildiz
6,171,504 B1 1/2001 Patterson
6,450,155 B1 9/2002 Arkfield
6,596,163 B1 7/2003 Parker
6,599,419 B2 7/2003 Hagans
6,602,411 B1 8/2003 Aida
6,707,362 B1 3/2004 Adam

MAGNETIC FUEL TREATMENT APPARATUS FOR ATTACHMENT TO A FUEL LINE

BACKGROUND OF THE INVENTION

1. Field of the Invention

The present invention generally relates to an apparatus for magnetically treating a liquid as it flows through conduit structure. More particularly, the present invention relates to a fuel treatment apparatus designed to magnetically treat fuel flowing through a fuel conduit as it flows from a fuel source to a fuel combustion chamber for generally enhancing or improving the combustive properties of the fuel.

2. Description of the Prior Art

For an interesting discussion on the topic of exposing hydrocarbon molecules to magnetic fields for enhancing the combustive properties thereof, the reader is directed to U.S. Pat. No. 5,558,765, which issued to Twardzik and discloses an Apparatus for Subjecting Hydrocarbon-Based Fuels to Intensified Magnetic Fields for Increasing Fuel Burning Efficiency ('765 patent) (See generally Column Nos. 1 and 2). Essentially, when a magnetic force is applied across the path of a flowing hydrocarbon fuel, the hydrocarbon molecules tend to align with the direction of the magnetic field. As the axis of the electrons in the hydrocarbon molecules become aligned with the external magnetic field, the angular momentum of the molecule no longer averages out to zero as is the normal case in molecules not possessing permanent dipole moments. The fluctuating dipole moments under the influence of the external magnetic field acquire a net attractive force which produces a stronger bonding with oxygen ions . . . As a result of the produced moment, the complex fuel molecules tend to uncluster, straighten and produce higher combustion efficiencies. The increase in combustion efficiency is attributable to the unfolding of the hydrocarbon molecules which produce an increased surface area for more complete oxidation of the fuel. The unfolding of the fuel molecules is the major effect of the dipole being removed from its neutral state by the applied magnetic field. See the '765 patent, Column No. 1, Line Nos. 55–67 and Column No. 2, Line Nos. 1–3.

A myriad of devices, apparatuses, and systems have been developed in an effort to build upon the scientific principles underlying the goal of enhancing combustive properties of hydrocarbon based fuels by exposing the same to directed magnetic fields. The '765 patent, for example, teaches an apparatus for exposing hydrocarbon based fuels to a magnetic field comprising at least two permanent magnets having opposite faces polarized north and south, a cover box for containing each of said magnets and having a bottom opening and a peripheral depending flange having curved hollows for fitting closely about a fluid compartment vessel. Further disclosed is a backing plate for closing the bottom opening being recessed inward to permit the close fit of the fluid containment vessel within the curved hollows and strapping means for securing the cover box in fixed diametrically opposed position about the fluid containment vessel for creating an electromagnetic circuit having an enhanced substantially uniform non-directional magnetic flux density for the polarization of the molecules of the fuel to increase the combustion efficiency thereof.

Other relatively pertinent patent disclosures that expound upon the general concept of magnetically treating fluids by directing magnetic fields through the magnetically treatable fluids include U.S. Pat. Nos. 4,572,145; 4,601,823; 4,605, 145; 4,611,615; 4,659,479; 4,711,271; 4,716,024; 4,734,202; 4,755,288; 4,761,228; 4,808,306; 4,933,151; 4,935,133; 4,956,084; 4,946,590; 4,999,106; 5,024,271; 5,024,759; 5,030,344; 5,037,546; 5,044,347; 5,059,743; 5,063,368; 5,069,190; 5,076,246; 5,078,870; 5,124,045; 5,127,385; 5,129,382; 5,130,032; 5,171,487; 5,227,683; 5,236,670; 5,238,558; 5,243,946; 5,254,247; 5,269,915; 5,271,834; 5,307,779; 5,320,751; 5,329,911; 5,348,050; 5,359,979; 5,364,536; 5,366,623; 5,408,498; 5,411,143; 5,454,943; 5,460,718; 5,487,370; 5,500,121; 5,520,158; 5,520,158; 5,533,490; 5,536,401; 5,589,065; 5,664,546; Re. 35,689; U.S. Pat. Nos. 5,716,520; 5,783,074; 5,804,067; 5,882,514; 5,943,998; 5,992,398; 6,041,763; 6,171,504; 6,450,155; 6,596,163; 6,599,419; 6,602,411; and 6,707,362.

From an inspection of these patent disclosures and other art generally known in the relevant art, it will be seen that the prior art does not teach a hydrocarbon fuel treatment system that, in combination, comprises a fuel line assembly and a fuel treatment apparatus as specifically described throughout the following disclosure. The prior art thus perceives a need for a hydrocarbon fuel treatment system that comprises, in combination, a fuel line assembly and a fuel treatment apparatus as specifically described hereinafter. Excellent results have been obtained utilizing the fuel treatment apparatus as installed on fuel lines. Specifically, the device was tested by placing the same on diesel fuel lines on five long range hauler type semi-trailer type configurations. In this regard, when the fuel treatment apparatus was placed on the fuel lines of 6 test trucks, Test Truck No. 1 showed an increase of 1.1 mpg or 24% average; Test Truck No. 2 showed an increase of 0.5 mpg or 10% average; Test Truck #3 showed no significant increase in mpg; Test Truck #4 showed an increase of 0.7 mpg or 16% average; Test Truck No. 5 showed an increase of 1.0 mpg or 26% average; and Test Truck No. 6 showed an increase of 0.6 mpg of 9% average. It is noted hat environmentally harmful or detrimental emissions from more efficiently burned or combusted fuel in engines of the sort here described will also be significantly decrease, although specific test results in this regard, were not evaluated.

SUMMARY OF THE INVENTION

It is a primary object of the present invention to provide a low cost fuel treatment apparatus that may be easily attached to a fuel line for enhancing the fuel efficiency of the vehicle on which it is installed. It is a further object of the present invention to provide a fuel treatment apparatus that maximizes fuel efficiency by harnessing or directing magnetic fields through fuel prior to its combustion, which fuel treatment apparatus has minimal cost. It is thus an object of the present invention to "get more bang for one's buck". It is a further object of the present invention to provide a magnet housing or magnet cradle assemblage that is mountable upon a fuel line, which when mounted presents zero mechanical stress on the magnet members during assembly. Still further, it is an object of the present invention to provide a magnet that is relatively free floating in the magnet housing or magnet cradle assemblage to allow for expansion and contraction of the magnet member due to the thermal environment inside the engine compartment of the vehicle on which the apparatus is installed. Further still, it is an object of the present invention to provide a magnet housing which places or locates the magnetic field-imposing magnets as close as 0.005 inches off the fuel line without any material between the magnet and the fuel line so as to more effectively maintain the directed magnetic field through the fuel line. It is a further object of the present invention to provide a keyed magnet cradle assemblage so as to insure proper or correct magnet polarization during assembly.

To achieve these and other readily apparent objectives, the present invention provides a hydrocarbon fuel treatment system that, in a main embodiment, comprises a fuel line assembly and a fuel treatment apparatus wherein the fuel line assembly comprises a fuel source, a fuel combustion chamber, and a fuel conduit. The fuel conduit is positioned intermediate the fuel source and the fuel combustion chamber for directing a flow of hydrocarbon fuel from the fuel source to the fuel combustion chamber.

The fuel treatment apparatus is designed to magnetically treat the hydrocarbon or similar other type fuel flowing through the fuel conduit. The fuel treatment apparatus essentially comprises an upper magnet assembly, a lower magnet assembly and fastening means for removably fastening the upper magnet assembly to the lower magnet assembly. The upper magnet assembly comprises an upper magnet positioning cradle and an upper magnet member. The upper magnet positioning cradle comprises a substantially rectangular upper frame, first and second upper frame seat flanges, and first and second upper frame fastener flanges. Being substantially rectangular in configuration, the upper frame comprises first and second upper frame end walls, and first and second upper frame side walls. The upper frame further comprises a distal upper frame end, a proximal upper frame end, an interior upper frame surface, and an exterior upper frame surface.

The upper frame end walls each comprise two laterally-spaced upper frame markers. The upper frame seat flanges are integrally formed with the upper frame side walls at the interior upper frame surface and extend from the first upper frame end wall to the second upper frame end wall to the upper frame markers intermediate the distal upper end and the proximal upper end. The upper frame seat flanges are coplanar in an inferior magnet end plane and define a medially-aligned, substantially rectangular upper frame gap located intermediate the upper frame markers.

The upper frame fastener flanges are integrally formed with the upper frame end walls at the exterior upper frame surface and extend from the first upper frame side wall to the second upper frame side wall. The upper frame fastener flanges each comprise a proximal conduit-receiving upper groove. The upper grooves each are semi-circular in configuration and thus have a distally-extending upper frame radius of curvature extending from the proximal upper frame end to the inferior magnet end plane, the inferior magnet end plane being substantially tangential to the upper grooves. The upper magnet member has a proximal upper magnet end and a distal upper magnet end and is designed for seatable engagement with the upper frame seat flanges.

Similar to the upper magnet assembly, the lower magnet assembly comprises a lower magnet positioning cradle and a lower magnet member. The lower magnet positioning cradle comprises a substantially rectangular lower frame, first and second lower frame seat flanges, and first and second lower frame fastener flanges. Also being substantially rectangular, the lower frame comprises first and second lower frame end walls, and first and second lower frame side walls. Further, the lower frame comprises a distal lower frame end, a proximal lower frame end, an interior lower frame surface, and an exterior lower frame surface. The lower frame end walls each comprise two laterally-spaced lower frame markers. The lower frame seat flanges are integrally formed with the lower frame side walls at the interior lower frame surface and extend from the first lower frame end wall to the second lower frame end wall to the lower frame markers intermediate the distal lower end and the proximal lower end. The lower frame seat flanges are coplanar in a superior magnet end plane and define a medially-aligned, substantially rectangular lower frame gap located intermediate the lower frame markers.

The lower frame fastener flanges each comprise a proximal conduit-receiving lower groove. The lower grooves each are semi-circular in configuration and thus have a distally-extending lower frame radius of curvature extending from the proximal lower frame end to the superior magnet end plane. The superior magnet end plane is substantially tangential to the lower grooves. The lower magnet member has a proximal lower magnet end and a distal lower magnet end and is designed for seatable engagement with the lower frame seat flanges. Together, the upper grooves and the lower grooves cooperatively form axially-aligned conduit-receiving apertures and the fuel conduit is receivable through the conduit-receiving apertures when the upper and lower magnet assemblies are assembled or fastened together. The fuel treatment apparatus, when fastened via the fastening means in adjacency to the fuel conduit magnetically treats hydrocarbon fuel flowing through the fuel conduit.

Other objects of the present invention, as well as particular features, elements, and advantages thereof, will be elucidated in, or apparent from, the following description and the accompanying drawing figures.

BRIEF DESCRIPTION OF THE DRAWINGS

Other features of our invention will become more evident from a consideration of the following brief description of patent drawings, as follows.

DETAILED DESCRIPTION OF THE PREFERRED EMBODIMENT

Figure 1:
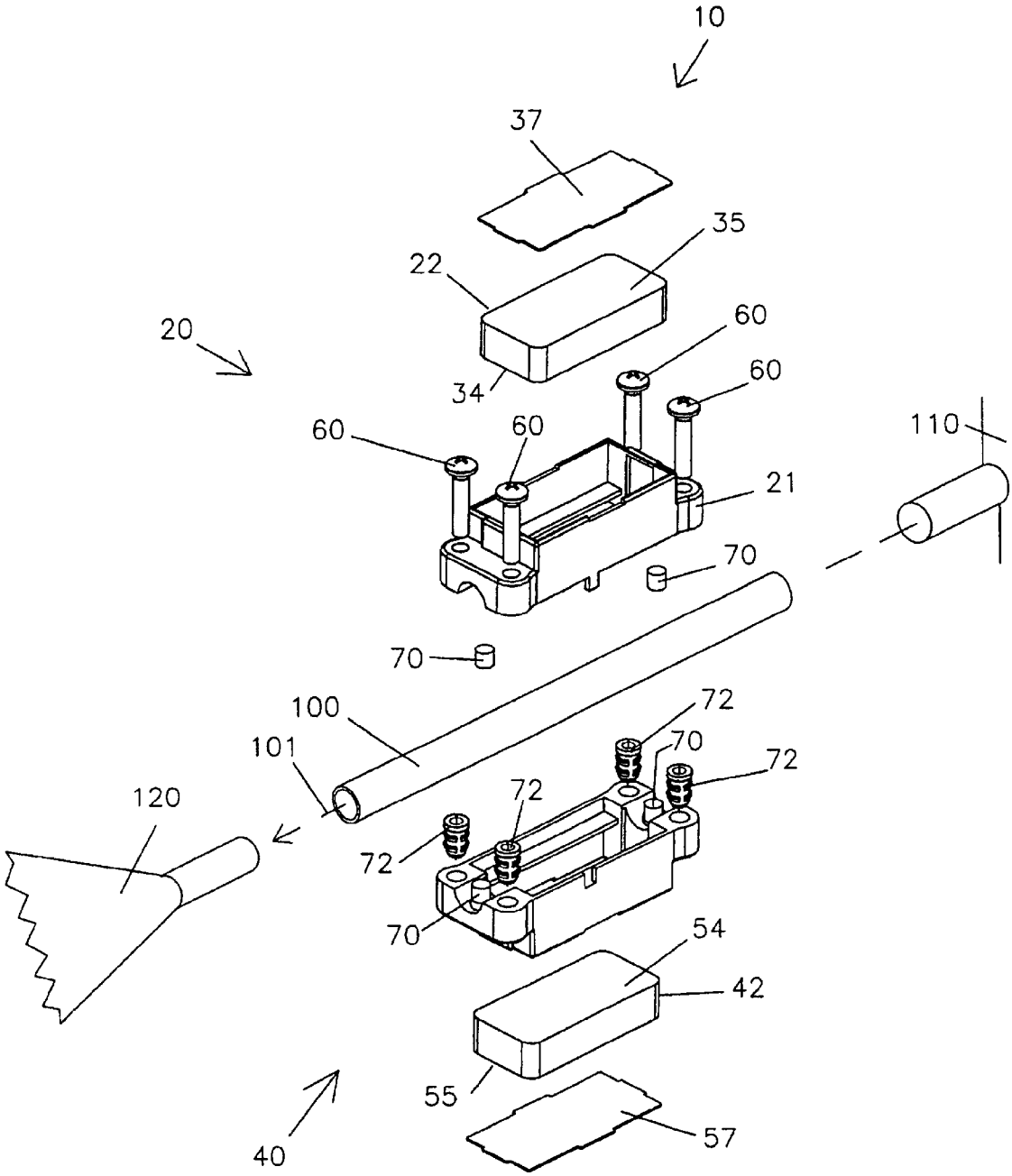
FIG. 1 is a fragmentary exploded perspective view of a preferred embodiment of the fuel treatment apparatus and fuel line assembly.
Figure 2:
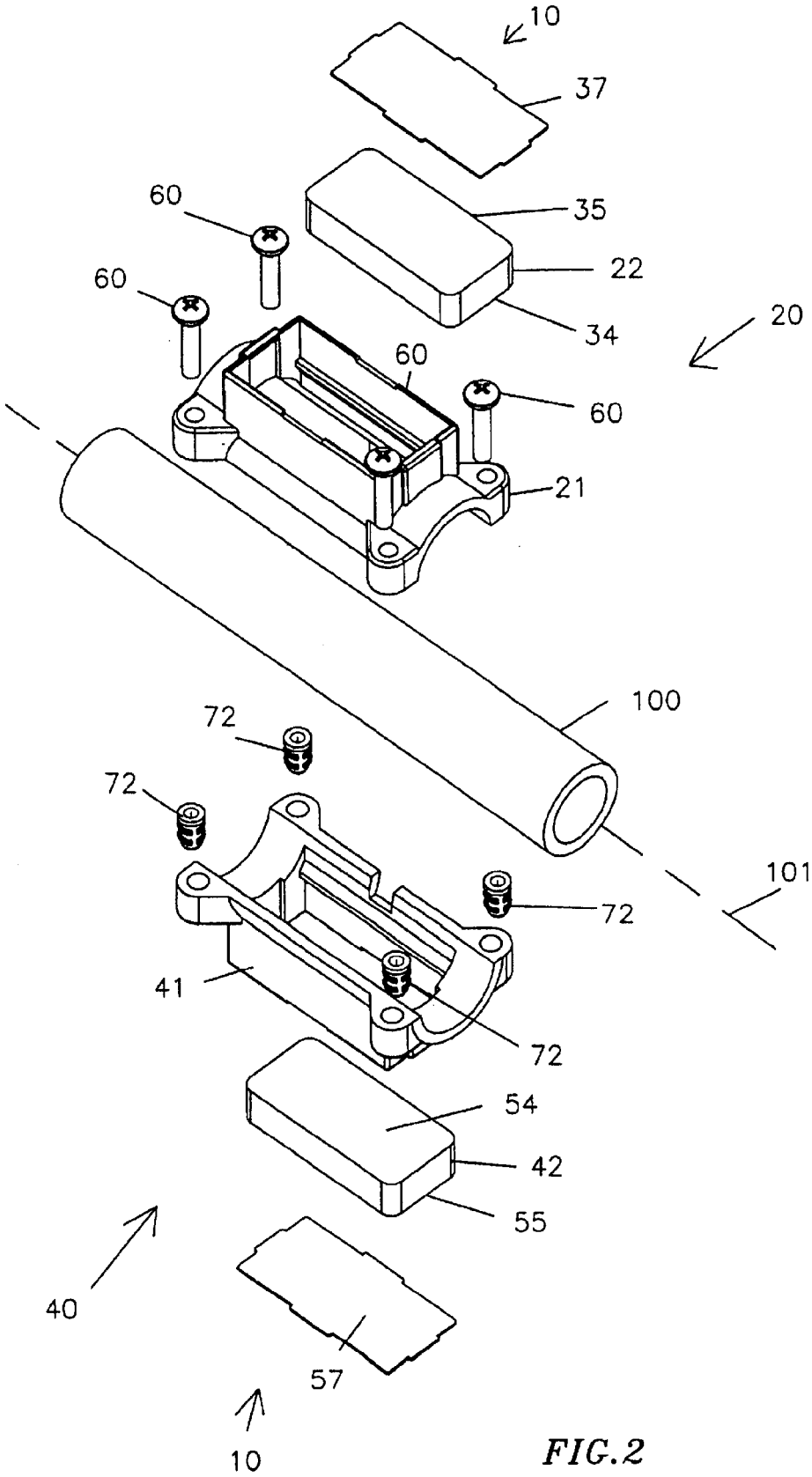
FIG. 2 is a fragmentary exploded perspective view of a first alternative embodiment of the fuel treatment apparatus and fuel conduit.

Referring now to the drawings, the preferred embodiment of the present invention generally concerns a fuel treatment system wherein the fuel treatment system preferably comprises, in combination, a fuel line assembly and a fuel treatment apparatus 10 for attachment to the fuel line assembly as generally illustrated in exploded views (in FIGS. 1 and 2). As earlier noted, excellent results have been obtained utilizing the fuel treatment apparatus as installed on fuel lines. Specifically, the device was tested by placing the same on diesel fuel lines on five long range hauler type semi-trailer type configurations. In this regard, when the fuel treatment apparatus was placed on the fuel lines of 6 test trucks, Test Truck No. 1 showed an increase of 1.1 mpg or 24% average; Test Truck No. 2 showed an increase of 0.5 mpg or 10% average; Test Truck #3 showed no significant increase in mpg; Test Truck #4 showed an increase of 0.7 mpg or 16% average; Test Truck No. 5 showed an increase of 1.0 mpg or 26% average; and Test Truck No. 6 showed an increase of 0.6 mpg or 9% average. It is noted that environmentally harmful or detrimental emissions from more efficiently burned or combusted fuel in engines of the sort here described will also be significantly decrease, although specific test results in this regard, were not evaluated.

Fuel treatment apparatus 10 is further illustrated and referenced in FIGS. 3–15, inclusive. It is contemplated that the fuel treatment apparatus 10 of the present invention may be mounted on and thus used in combination with a fuel line assembly. It is thus contemplated that the fuel line assembly preferably comprises a fuel source 110, a fuel combustion compartment 120, and a fuel conduit 100 all as generically illustrated and referenced in FIGS. 1 and 15. Fuel conduit 100 is further illustrated and referenced in FIGS. 2–14, inclusive. It will be understood from a general inspection of FIGS. 1 and 15 that fuel conduit 100 is preferably positioned intermediate fuel source 10 and fuel combustion chamber 120 for directing a flow of fuel from fuel source 110 to fuel combustion chamber 120.

Figure 3:
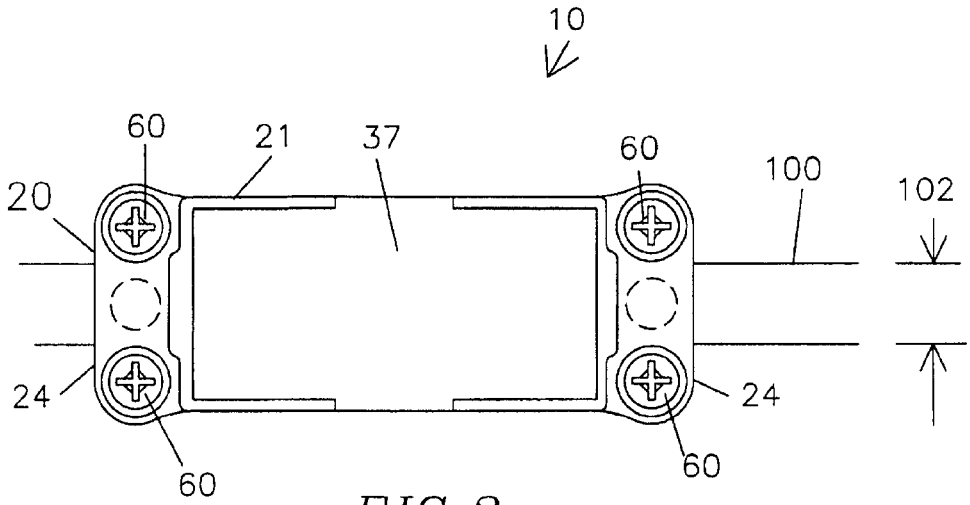
FIG. 3 is a fragmentary top plan view of the fuel treatment apparatus as assembled on a fuel conduit.
Figure 4:
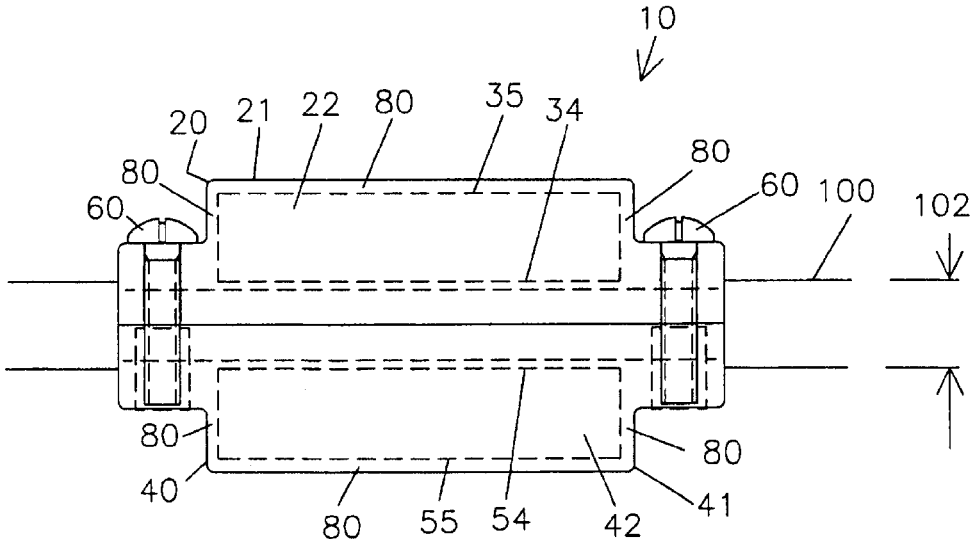
FIG. 4 is a fragmentary cross-sectional side view of the fuel treatment apparatus as assembled on the fuel conduit as shown in FIG. 3 with certain structures shown in phantom for emphasis.
Figure 5:
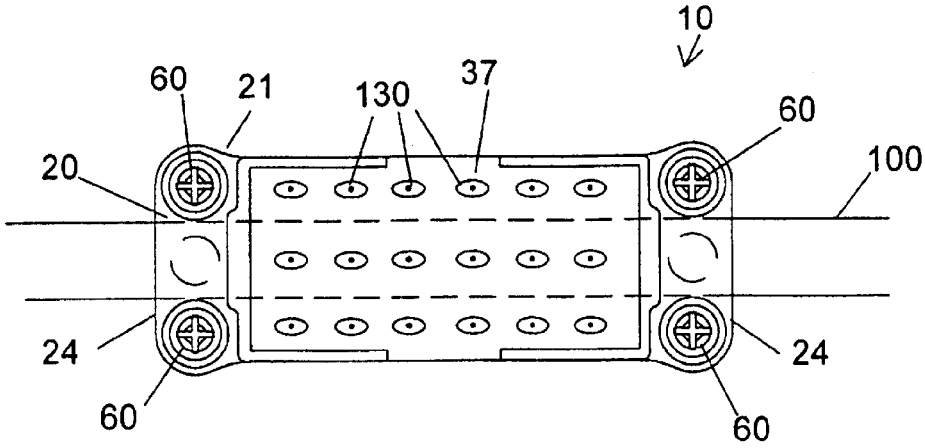
FIG. 5 is a fragmentary top plan view of the fuel treatment apparatus as assembled on a fuel conduit depicting magnetic field lines directed out of the page.
Figure 6:
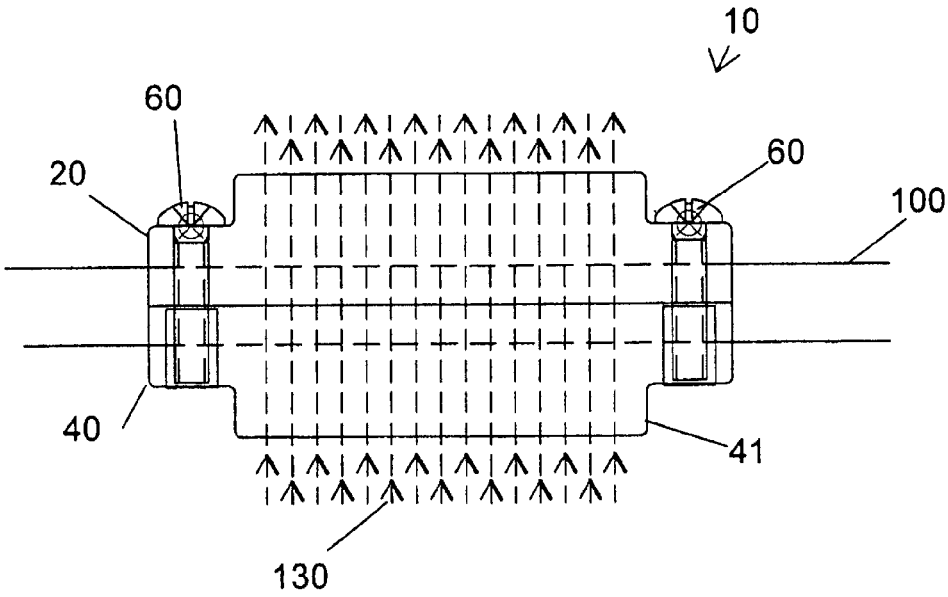
FIG. 6 is a fragmentary cross-sectional side view of the fuel treatment apparatus as assembled on the fuel conduit as shown in FIG. 5 with certain structures shown in phantom for emphasis, depicting upwardly directed magnetic field lines.
Figure 7:
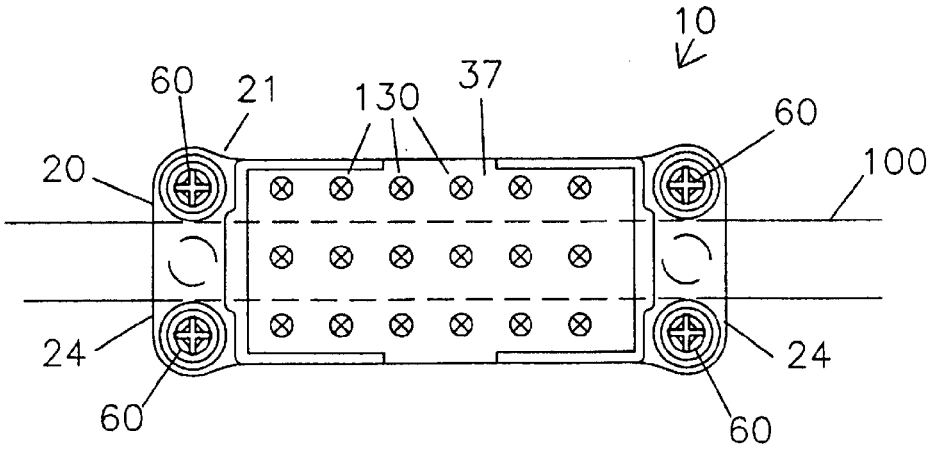
FIG. 7 is a fragmentary top plan view of a fuel treatment apparatus as assembled on a fuel conduit depicting magnetic field lines directed into the page.
Figure 8:
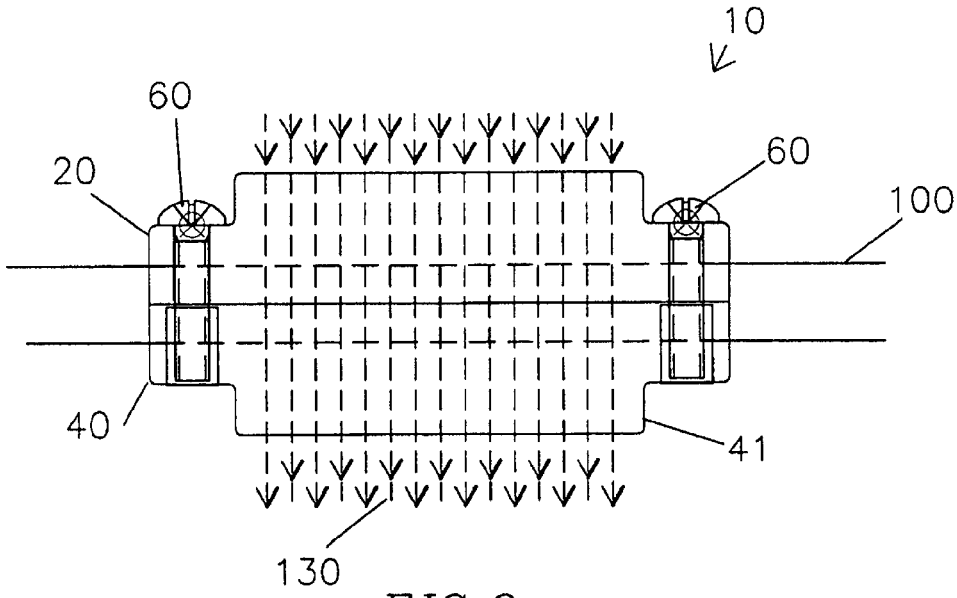
FIG. 8 is a fragmentary cross-sectional side view of the fuel treatment apparatus as assembled on the fuel conduit shown in FIG. 7 with certain structures shown in phantom for emphasis, depicting downwardly directed magnetic field lines.
Figure 9:
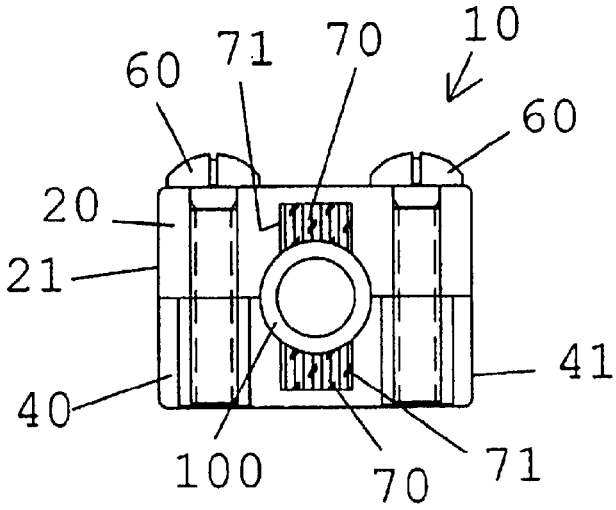
FIG. 9 is a first cross-sectional end view of the fuel treatment apparatus as assembled on a fuel conduit.
Figure 10:
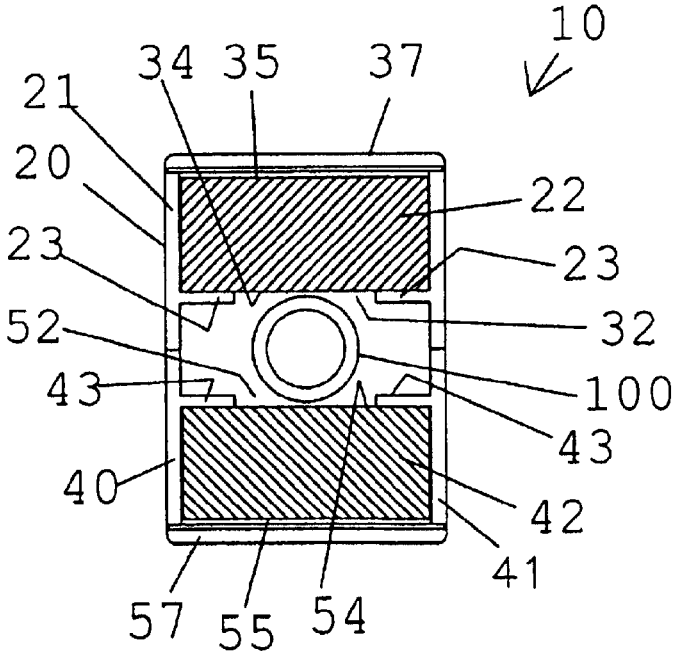
FIG. 10 is a second cross-sectional end view of the fuel treatment apparatus as assembled on a fuel conduit.
Figure 11:
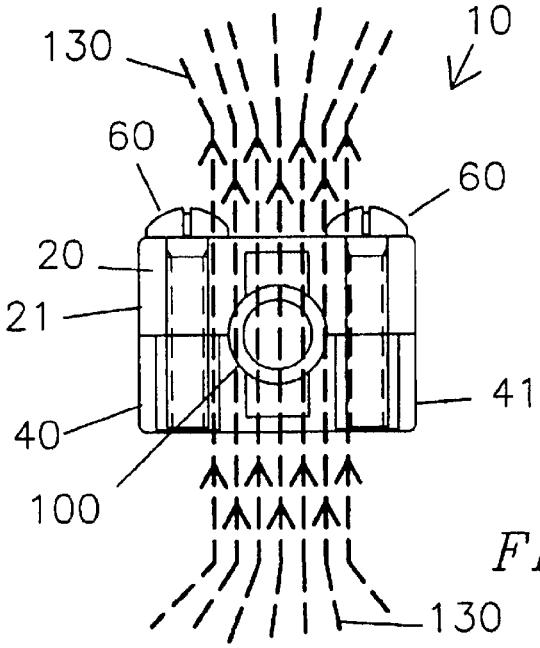
FIG. 11 is the first cross-sectional end view of the fuel treatment apparatus as assembled on a fuel conduit depicting upwardly directed magnetic field lines.
Figure 12:
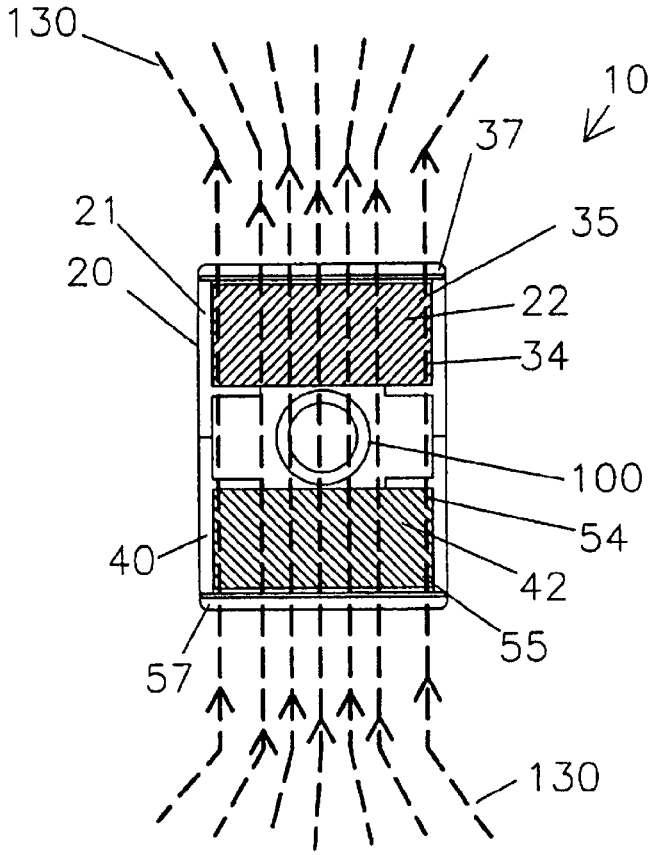
FIG. 12 is the second cross-sectional end view of the fuel treatment apparatus as assembled on a fuel conduit depicting upwardly directed magnetic field lines.
Figure 13:
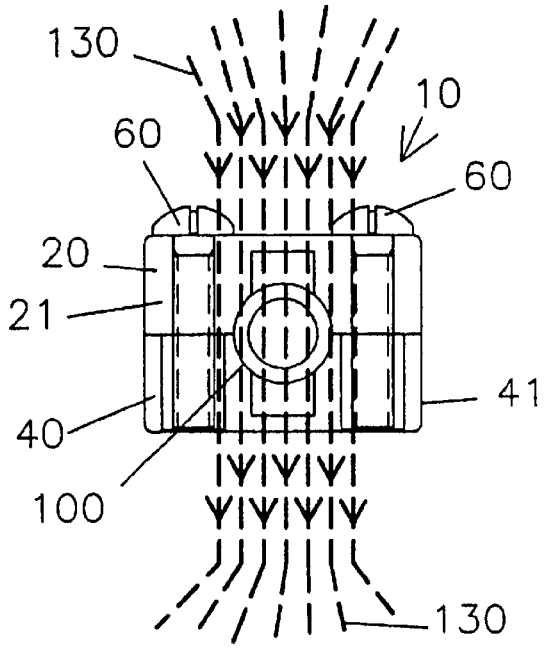
FIG. 13 is the first cross-sectional end view of the fuel treatment apparatus as assembled on a fuel conduit depicting downwardly directed magnetic field lines.
Figure 14:
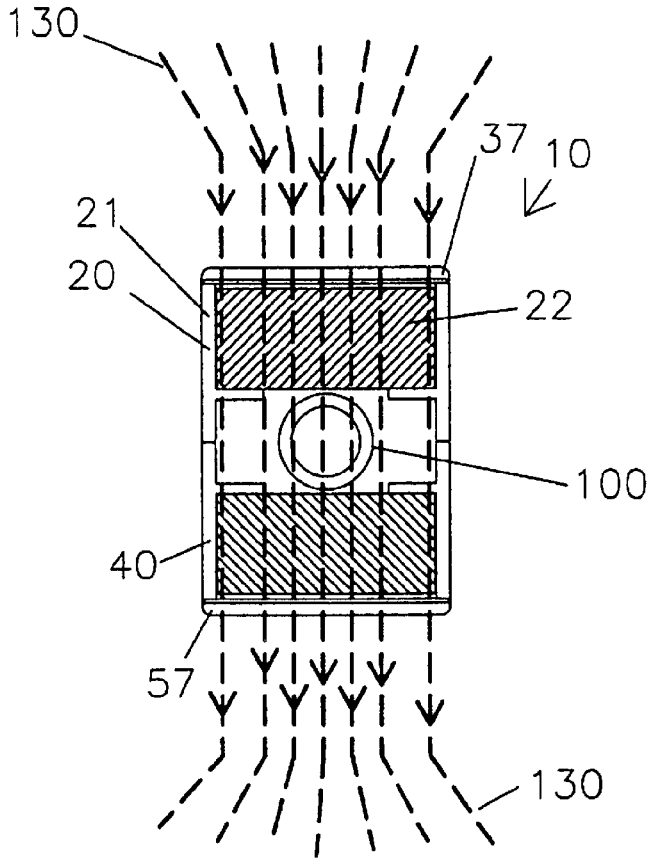
FIG. 14 is the second cross-sectional end view of the fuel treatment apparatus as assembled on a fuel conduit depicting downwardly directed magnetic field lines.
Figure 15:
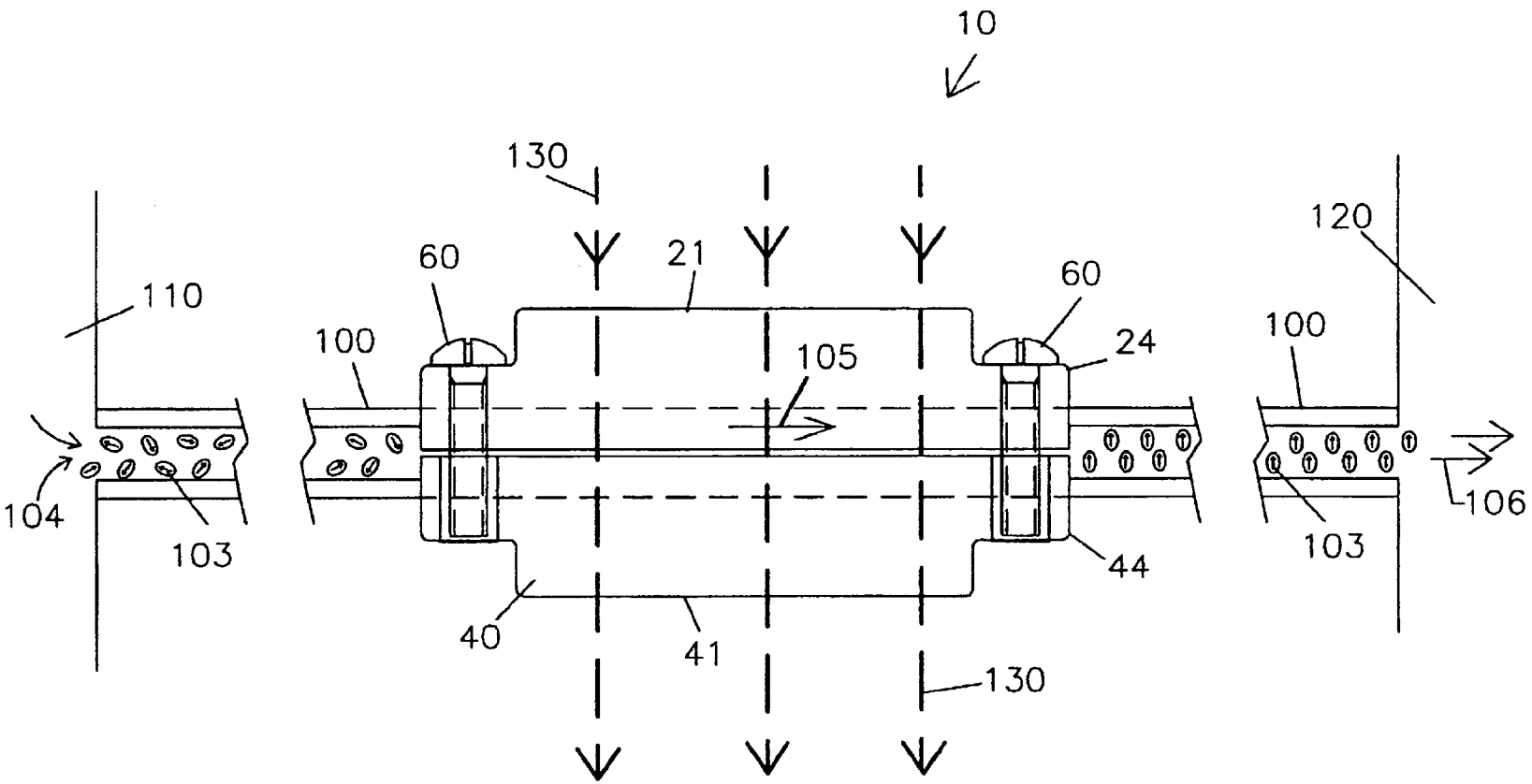
FIG. 15 is a fragmentary cross-sectional side view of the fuel treatment apparatus and fuel line assembly depicting downwardly directed magnetic field lines.

It is contemplated that in the preferred embodiment of the present invention fuel conduit 100 comprises a substantially linear conduit axis (as referenced at 101 in FIGS. 1 and 2) and an outer conduit periphery or outer conduit diameter (as referenced at 102 in FIGS. 3 and 4). Hydrocarbon fuels and the like typically comprise positively and negatively charged regions and thus the imposition of a magnetic field across the path of flowing hydrocarbon fuels and similar other fuels operates to magnetically treat the fuel so that the positive and negative charges are aligned more uniformly before the fuel enters fuel combustion chamber 120 as earlier described. FIG. 15 generally depicts bulk fuel leaving fuel source 110 (as indicated at 104), the molecular structure of which has been exaggerated for effect. It will be seen that the bulk fuel leaving fuel source 110 comprises randomly oriented charged molecular structure as represented by arrow indicia upon the exaggerated molecular structure as generally illustrated and referenced at 103. As the fuel travels or flows through fuel treatment apparatus 10 (as indicated at 105) the randomly oriented charged molecular structure 103 becomes less random and more uniform.

As earlier presented, when a magnetic force is applied across the path of a flowing hydrocarbon fuel, the hydrocarbon molecules tend to align with the direction of the magnetic field. As the axis of the electrons in the hydrocarbon molecules become aligned with the external magnetic field, the angular momentum of the molecule no longer averages out to zero as is the normal case in molecules not possessing permanent dipole moments. The fluctuating dipole moments under the influence of the external magnetic field acquire a net attractive force which produces a stronger bonding with oxygen ions . . . As a result of the produced moment, the complex fuel molecules tend to uncluster, straighten and produce higher combustion efficiencies. The increase in combustion efficiency is attributable to the unfolding of the hydrocarbon molecules which produce an increased surface area for more complete oxidation of the fuel. The unfolding of the fuel molecules is the major effect of the dipole being removed from its neutral state by the applied magnetic field. See the '765 patent, Column No. 1, Line Nos. 55–67 and Column No. 2, Line Nos. 1–3.

Thus, when the fuel exits fuel treatment apparatus 10 as depicted at 106, the charged molecular structure 103 is more uniformly oriented and otherwise magnetically treated for combustion purposes inside combustion chamber 120. Fuel treatment apparatus 10 thus operates to impose a directed magnetic field 130 upon the fuel traveling or flowing through fuel treatment apparatus 10. Directed magnetic field 130 is generally shown with broken field lines in FIGS. 6, 8, 11–14, and 15, with out of the page identifiers in FIG. 5 and with into the page identifiers in FIG. 7.

Thus, it should be understood that fuel treatment apparatus 10 is designed to magnetically treat hydrocarbon fuel or similar other type fuel flowing through fuel conduit 100 and in this regard preferably comprises an upper magnet assembly 20 as illustrated and referenced in FIGS. 1–15, inclusive; a lower magnet assembly 40 as illustrated in FIGS. 1, 2, 4, 6, and 8–15, inclusive; and select fastening means for removably fastening upper magnet assembly 20 to lower magnet assembly 40. Preferably, the fastening means may be defined by comprising a fastening assembly comprising a total of four corner-mounted screws 60 as generally illustrated and referenced in FIGS. 1–9, 11, 13, 15, and 16.

The first magnet assembly or upper magnet assembly 20 preferably comprises an upper magnet positioning cradle 21 as illustrated and referenced in FIGS. 1–16; a first or upper magnet member 22 as illustrated and referenced in FIGS. 1, 2, 4, 10, 12, and 14; and an upper magnet cover plate 37 as illustrated and referenced in FIGS. 1, 2, 3, 5, 7, 10, 12, and 14. Upper magnet positioning cradle 21 is preferably constructed from nonmagnetic materials. In this regard, it is contemplated that upper magnet positioning cradle 21 is preferably constructed from injection molded plastic material such as polyphenyl oxide (PPO) and is molded to preferably comprise a substantially rectangular upper frame as can be generally seen from an inspection of FIGS. 1, 2, and 16. Further, upper magnet positioning cradle 21 preferably comprises first and second upper frame seat flanges 23, both of which are referenced in FIG. 10 and one of which has been illustrated and referenced in FIG. 16. Still further, upper magnet positioning cradle 21 preferably comprises first and second upper frame fastener flanges 24 both of which have been illustrated and referenced in FIGS. 3, 5, 7, 15, and 16. Being preferably rectangular in configuration, the upper frame preferably comprises first and second upper frame end walls 25; first and second upper frame side walls 26; a distal upper frame end 27, a proximal upper frame end 28, an interior upper frame surface 29, and an exterior upper frame surface 30 all as illustrated and referenced in FIG. 16. Upper frame end walls 25 each preferably further comprise two laterally-spaced upper frame markers 31, one pair of which have been further illustrated and referenced in FIG. 16.

Figure 16:
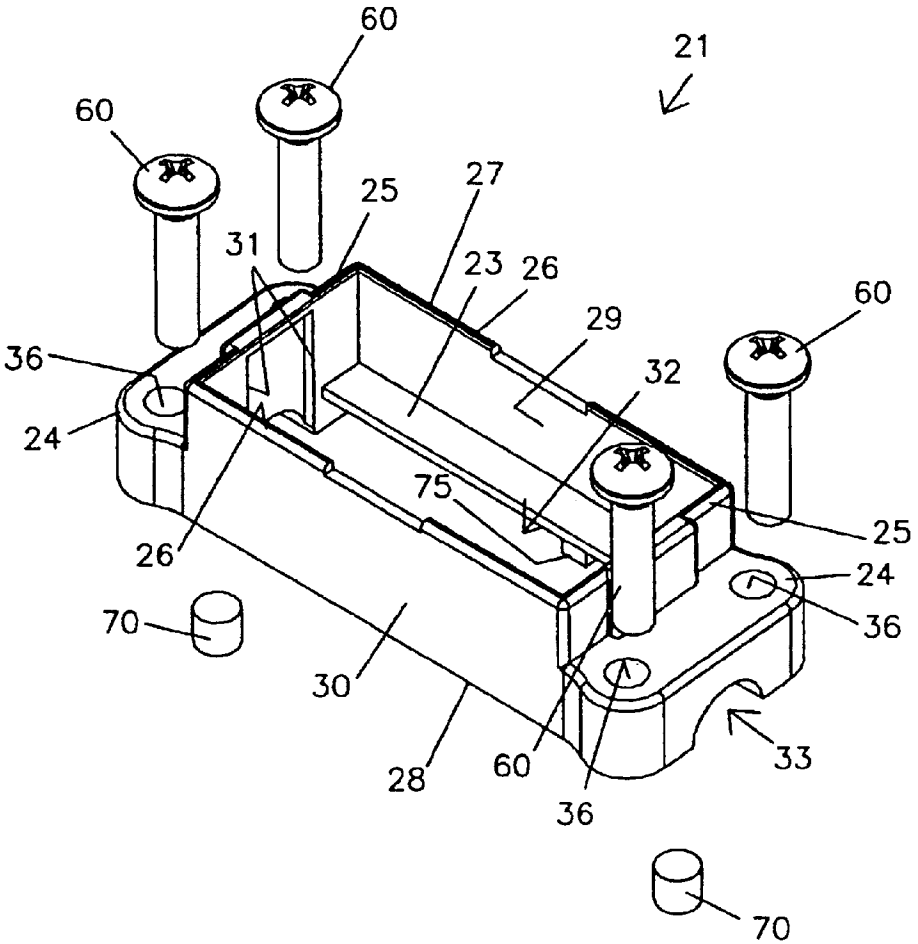
FIG. 16 is a perspective view of the upper magnet positioning cradle with four screws and two rubber stop members shown exploded therefrom.

It will be understood from a close inspection of FIG. 16 as well as from a general inspection of FIGS. 1 and 2 that upper frame seat flanges 23 are integrally formed with upper frame side walls 26 at interior upper frame surface 29 and extend from the first upper frame end wall 25 to the second upper frame end wall 25 to upper frame markers 31 intermediate distal upper end 27 and proximal upper end 28. In other words, upper frame seat flanges 23 are essentially ledges upon which upper magnet member 22 will seat. Upper frame seat flanges 23 are thus preferably coplanar in an inferior magnet end plane and define a medially-aligned, substantially rectangular upper frame gap extending from the upper frame markers 31 of the first upper frame end wall 25 to the upper frame markers 31 of the second upper frame end wall 25. Thus, upper frame gap 32 is essentially an open space intermediate the four upper frame markers 31. The upper frame gap is generally referenced at 32 in FIG. 16. Given upper frame gap 32 and the structural feature that upper magnet member 22 will seat upon upper frame seat flanges 23, upper magnet member 22 will typically lie as close as 0.005 inches away from fuel conduit 100 without any plastic or metal between upper magnet member 22 and fuel conduit 100.

Upper frame fastener flanges 24 are preferably integrally formed with the upper frame end walls 25 at exterior upper frame surface 30 and extend from the first upper frame side wall 26 to the second upper frame side wall 26. Upper frame fastener flanges 24 each preferably comprise a proximal conduit-receiving upper groove 33 and two upper frame fastener-receiving apertures 36. One (of two) conduit-receiving upper groove 33 has been generally referenced in FIGS. 10 and 16 and three (of four) frame fastener-receiving apertures 36 have been illustrated and referenced in FIG. 16. In the preferred embodiment, upper grooves 33 are each preferably semi-circular in configuration and thus each have a distally-extending upper frame radius of curvature extending from proximal upper frame end 28 to the inferior magnet end plane (in which plane the upper frame seat flanges 23 both lie). It will thus be understood that the inferior magnet end plane is substantially tangential to the upper grooves 33.

The preferred construction of upper magnet member 22 is a standard ceramic magnet 5, Product No. MAS20, or an equivalent from Bunting Magnetics Co. with current business address of 500 S. Spencer Avenue (P.O. Box 468), Newton, Kans., 67114-0468. Upper magnet member 22 has a preferred magnetic field strength of 1000–1500 Gauss. It will be understood from an inspection of various applicable figures that upper magnet member 22 is preferably of a substantially rectangular parallelepiped configuration. Upper magnet member 22 thus preferably comprises a proximal upper magnet end 34 and a distal upper magnet end 35 as illustrated and referenced in FIGS. 1, 2, 4, 10, and 12. As earlier indicated, upper magnet member 22 is designed for seatable engagement with upper frame seat flanges 23 as specifically depicted in FIG. 10 and as generally depicted from an exploded viewpoint in FIGS. 1 and 2.

Upper magnet cover plate 37 is preferably also constructed from relatively nonmagnetic material. It is contemplated that upper magnetic cover plate 37 is preferably constructed from chrome-plated brass so as to provide for a more aesthetically-attractive fuel treatment apparatus 10. Upper magnet cover plate 37 is removably attachable to distal upper frame end 27 and essentially functions to maintain upper magnet member 22 in seated engagement within upper magnet positioning cradle 21 as specifically depicted in FIGS. 10, 12, and 14 and as generally depicted from an exploded viewpoint in FIGS. 1 and 2.

The second magnet assembly or lower magnet assembly 40 preferably comprises a lower magnet positioning cradle 41 as illustrated and referenced in FIGS. 1, 2, 4, 6, 8–15, and 17; a lower magnet member 42 as illustrated and referenced in FIGS. 1, 2, 4, 10, 12, and 14; and a lower magnet cover plate 57 as illustrated and referenced in FIGS. 2, 10, 12, and 14. Lower magnet positioning cradle 41 is preferably also constructed from nonmagnetic materials. In this regard, it is contemplated that lower magnet positioning cradle 41 is preferably constructed from injection molded plastic material such as polyphenyl oxide (PPO). Lower magnet positioning cradle 41 preferably comprises a substantially rectangular lower frame, first and second lower frame seat flanges 43 as illustrated and referenced in FIGS. 10 and 17; and first and second lower frame fastener flanges 44 as illustrated and referenced in FIGS. 15 and 17. Being substantially rectangular in the preferred configuration, the lower frame further comprises first and second lower frame end walls 45, first and second lower frame side walls 46, a distal lower frame end 47, a proximal lower frame end 48, an interior lower frame surface 49, and an exterior lower frame surface 50 all as illustrated and referenced in FIG. 17.

Figure 17:
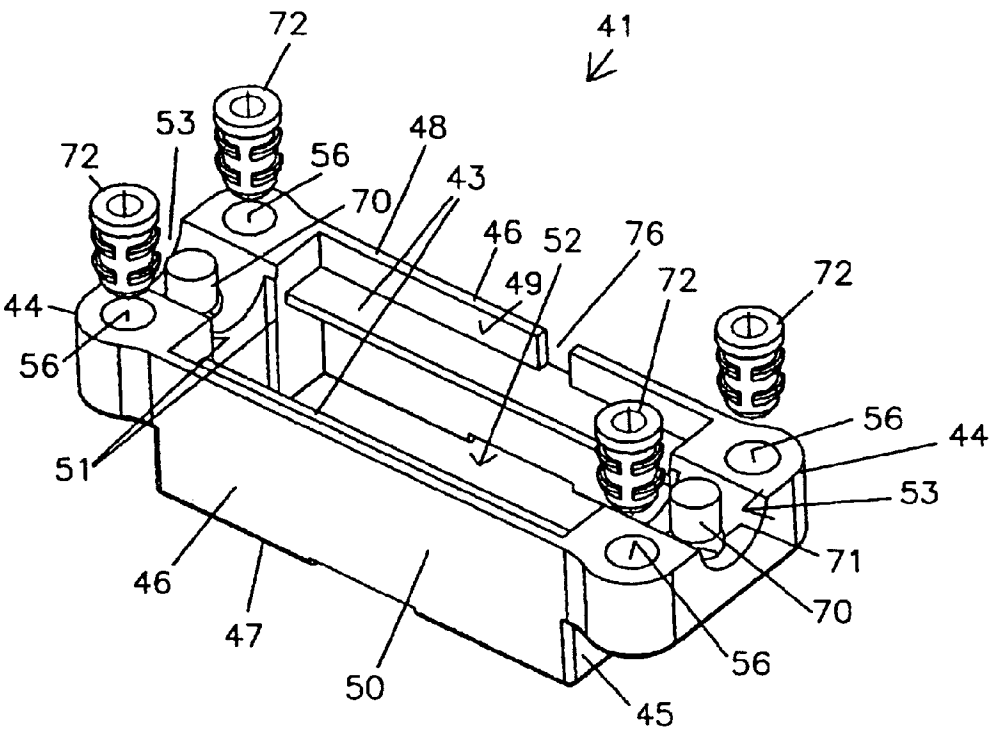
FIG. 17 is a perspective view of the lower magnet positioning cradle with four insert members and two rubber stop members shown exploded therefrom.

Notably, the lower frame end walls 45 each further preferably comprise two laterally-spaced lower frame markers 51 as referenced in FIG. 17. It should be understood from a consideration of the noted figure that lower frame seat flanges 43 are preferably integrally formed with lower frame side walls 46 at interior lower frame surface 49 and extend from the first lower frame end wall 45 to the second lower frame end wall 45 to the lower frame markers 51 intermediate distal lower frame end 47 and proximal lower frame end 48. Since lower magnet member 42 is designed for seated engagement with lower frame seat flanges 43, the lower frame seat flanges 43 are preferably coplanar in a superior magnet end plane and further define a medially-aligned, substantially rectangular lower frame gap 52, which lower frame gap 52 extends from the lower frame markers 51 of the first lower frame end wall 45 to the lower frame markers 51 of the second lower frame end wall. Thus, lower frame gap 52 is essentially an open space intermediate the four lower frame markers 51. Lower frame gap 52 has been referenced in FIGS. 10 and 17 for the reader. Given lower frame gap 52 and the structural feature that lower magnet member 42 will seat upon lower frame seat flanges 43, lower magnet member 42 will typically lie as close as 0.005 inches away from fuel conduit 100 without any plastic or metal between upper magnet member 22 and fuel conduit 100.

Lower frame fastener flanges 44 each preferably comprise a proximal conduit-receiving lower groove 53 and two lower frame fastener-receiving apertures 56. Both lower grooves 53 and all four lower frame fastener-receiving apertures 56 have been referenced in FIG. 17 for the reader. It will be seen from an inspection of FIG. 17 that lower grooves 53 are each preferably semi-circular in configuration and thus each having a distally-extending lower frame radius of curvature extending from proximal lower frame end 48 to the superior magnet end plane (in which plane the lower frame seat flanges 43 both lie). The superior magnet end plane is thus substantially tangential to the lower grooves 53.

The preferred construction of lower magnet member 42 is also a standard ceramic magnet 5, Product No. MA820, or an equivalent from Bunting Magnetics Co. with current business address of 500 S. Spencer Avenue (P.O. Box 468), Newton, Kans., 67114-0468. Lower magnet member 42 also has a preferred magnetic field strength of 1000–1500 Gauss. It will be understood from an inspection of various applicable figures that lower magnet member 42 is preferably of a substantially rectangular parallelepiped configuration and thus lower magnet member 42 preferably comprises a proximal lower magnet end 54 and a distal lower magnet end 55 as illustrated and referenced in FIGS. 1, 2, 4, 10, and 12. As earlier indicated, lower magnet member 42 is designed for seatable engagement with lower frame seat flanges 43 as specifically depicted in FIG. 10 and as generally depicted from an exploded viewpoint in FIGS. 1 and 2.

Lower magnet cover plate 57 is also preferably constructed from relatively nonmagnetic material. It is contemplated that lower magnetic cover plate 57 is also preferably constructed from chrome-plated brass so as to provide for a more aesthetically-attractive fuel treatment apparatus 10 when in an assembled state. Lower magnet cover plate 57 is removably attachable to distal lower frame end 47 and essentially functions to maintain lower magnet member 42 in seated engagement within lower magnet positioning cradle 41 as specifically depicted in FIGS. 10, 12, and 14 and as generally depicted from an exploded viewpoint in FIGS. 1 and 2.

When upper magnet assembly 20 and lower magnet assembly 40 are fastened together, upper grooves 33 and lower grooves 53 cooperatively forming axially-aligned conduit-receiving apertures. As earlier noted, a fastening assembly preferably fastens upper magnet assembly 20 to lower magnet assembly 40 and preferably comprises a total of four corner-mounted screws 60. It will thus be understood that of the four corner-mounted screws, two are essentially first end screws and two are essentially second end screws.

The upper frame fastener-receiving apertures 36 and the lower frame fastener-receiving apertures 56 cooperatively form two substantially parallel first end screw-receiving tunnels and two substantially parallel second end screw-receiving tunnels. It will be understood that the tunnels each have a screw-receiving axis, which axes are substantially orthogonal to the inferior and superior magnet end planes. The lower frame fastener-receiving apertures 56, and thus the fastening assembly, may further preferably comprise threaded insert members 72 (preferably constructed from nonmagnetic material—e.g. brass) for generally enhancing the fastening engagement of upper magnet assembly 20 to lower magnet assembly 40. The preferably nonmagnetic (preferably brass) threaded insert members 72 have been illustrated and referenced in FIGS. 1, 2, and 17.

It will be recalled that fuel conduit 100 preferably has substantially linear conduit axis 01 and outer conduit diameter 102 and thus fuel conduit 100 is designed to be receivable through the conduit-receiving apertures. Preferably, the conduit-receiving apertures comprise select conduit-gripping means for preventing the otherwise assembled fuel treatment apparatus 10 from moving (rotating or translating) relative to conduit axis 101. The select conduit-gripping means are preferably selected from the group consisting of friction-enhancing stop structure and conduit-receiving aperture sizing. It is contemplated that the friction-enhancing stop structure may preferably be defined by rubber friction stops 70 (one for each upper groove 33 and one for each lower groove 53) as illustrated and referenced in FIGS. 1, 9, 16, and 17. It is contemplated that if fuel treatment apparatus 10 is outfitted with rubber friction stops 70, upper grooves 33 and lower grooves 53 may further preferably comprise stop-receiving structure 71 (as referenced in FIGS. 9 and 17) at the distal most region of the groove. The stop-receiving structure are essentially hollows formed in the distal most regions of the grooves and are sized and shaped to snugly receive the rubber friction stops 70. Notably, the friction-enhancing stop structure should be constructed from a nonmagnetic material. Rubber friction stops are to be preferred in this regard for providing an adequate coefficient of static/kinetic friction and further insofar as the frictions stops are constructed from nonmagnetic material. From a general inspection of FIG. 9, it will be seen that the friction stops (constructed from compressible rubber) are compressed intermediate fuel conduit 100 and stop-receiving structure 71 and thus exert restorative forces against both fuel conduit 100 and stop-receiving structure 71 to provide for more effective friction-enhancing stop means.

It is contemplated that the conduit-receiving aperture sizing may preferably be defined by a conduit-gripping diameter. In other words, if the diameter of the conduit-receiving apertures is of such magnitude that outer conduit diameter 102 is snugly receivable such that adjoining surfaces are in frictional contact, the frictional contact may operate to prevent fuel treatment apparatus 10 from moving (rotating or translating) relative to conduit axis 101. Thus, it is contemplated that the conduit-gripping diameter (or periphery) is preferably substantially equal in magnitude to the outer conduit diameter 102 or periphery for preventing fuel treatment apparatus 10 from moving relative to conduit axis 101.

It is further contemplated that thermal environments inside engine compartments are relatively wide ranging in terms of temperature extremes. Materials undergo certain linear and volumetric expansions and contractions as temperatures increase and decrease. In this regard, it should be further noted that interior upper frame surface 29 of upper magnet-positioning cradle 21 and interior lower frame surface 49 of lower magnet-positioning cradle 41 are sized and shaped to allow for free (unobstructed) thermal expansion and contraction of upper magnet member 22 and lower magnet member 42, respectively. In this regard, the reader may wish to reference FIG. 4 where certain magnet member-enveloping spacing 80 has been referenced to allow for free thermal expansion and contraction. It is noted that ceramic magnets are typically constructed from strontium ferrous oxide and some other trace elements and that the coefficient of linear or volumetric expansion may be modest compared to some other more thermally expandable materials. However, provision here is made for an upper magnet-positioning cradle and a lower magnet positioning cradle that are sized and shaped to allow for thermal expansion and contraction of the corresponding magnet member as the manufacturer may opt to use a more thermally active (expansive and contractive) magnet member in lieu of a ceramic type magnet member.

It will be further understood that upper magnet member 22 and lower magnet member 42 together cooperatively form a magnetically-attractive pairing provided the northern magnetic pole of the first magnet member is positioned opposite the southern magnetic pole of the second magnet member. In other words, it is critical that proximal upper magnet end 34 and proximal lower magnet end 54 are magnetically attractive and not repulsive. Thus, the magnetically-attractive pairing is preferably chosen or selected from a select magnet grouping, the select magnet grouping consisting of a first and second magnet orientation. The first magnet orientation may preferably be defined by distal upper magnet end 35 having an upper magnetic north pole; proximal upper magnet end 34 having an upper magnetic south pole; distal lower magnet end 55 having a lower magnetic south pole; and proximal lower magnet end 54 having a lower magnetic north pole. The magnetic field thus generated from the first magnet orientation is generally depicted in FIGS. 5, 6, 11, and 12. By convention magnetic field lines are oriented from magnetic north poles to magnetic south poles. Thus, it will be seen that the magnetic field lines are upwardly directed in the noted figures since distal upper magnet end 35 is a magnetic north pole and distal lower magnet end 55 is a magnetic south pole. From an inspection of FIG. 5 (top plan view), it will be seen that the magnetic field lines are directed out of the page as referenced at 131 (by circles with centered dots) and further from an inspection of FIGS. 6 (side view), 11 (end view), and 12 (cross-sectional end view) that the magnetic field lines are upwardly directed.

The second magnet orientation may preferably be defined by distal upper magnet end 35 having an upper magnetic south pole; proximal upper magnet end 34 having an upper magnetic north pole; distal lower magnet end 55 having a lower magnetic north pole; and proximal lower magnet end 54 having a lower magnetic south pole. The magnetic field thus generated from the second magnet orientation is generally depicted in FIGS. 7, 8, 13, 14, and 15. By convention magnetic field lines are oriented from magnetic north poles to magnetic south poles. Thus, it will be seen that the magnetic field lines are downwardly directed in the noted figures since distal upper magnet end 35 is a magnetic south pole and distal lower magnet end 55 is a magnetic north pole. From an inspection of FIG. 7 (top plan view), it will be seen that the magnetic field lines are directed into the page as referenced at 130 (by circles with centered X's) and further from an inspection of FIGS. 8 (side view), 13 (end view), and 14 (cross-sectional end view) that the magnetic field lines are downwardly directed.

It will be further seen from an inspection of the noted figures that upper magnet member 22 and lower magnet member 42, as a cooperative magnetically-attractive pairing, comprise a directed magnetic field, which directed magnetic field is substantially orthogonal to conduit axis 101 as conduit axis 101 extends through fuel treatment apparatus 10. It is contemplated that the unique construction of fuel treatment apparatus 10 contributes to a relatively uniform magnetic field extending through fuel conduit 100 for more uniformly aligning the molecular structure of fuels, as earlier described. In this regard, it will be understood from a review of the specifications and descriptions found herein that the substantially rectangular parallelepiped magnet members create a relatively uniform, orthogonally-directed magnetic field through fuel conduit 100 as repeatedly depicted throughout the figures in the present disclosure.

A further structural feature of the present invention contributing to the maintenance of the directed magnetic field 130 is the cooperative alignment of upper frame gap 32 and lower frame gap 52 relative to upper magnet member 22 and lower magnet member 42, respectively. The absence of structure in these regions of fuel treatment apparatus 10 allows the directed magnetic field 130 to more uniformly align orthogonally to the conduit axis 101. Further, as has been earlier specified, upper magnet positioning cradle 21, lower magnet positioning cradle 41, upper magnet cover plate 37, lower magnet cover plate 57, and the friction-enhancing stop structure are preferably constructed from nonmagnetic materials as a means to enhance or maintain directed magnetic field 130. In this regard, it is contemplated that either 1) an absence of structure or (2) structures made from magnetically non-interfering materials will function to maintain an orthogonally uniform directed magnetic field 130 relative to conduit axis 101. If the various structures of fuel treatment apparatus 10 were to be constructed from magnetic materials, directed magnetic field 130 may be otherwise compromised in directed magnetic field strength or uniformity.

It is further contemplated that upper magnet positioning cradle 21 and lower magnet positioning cradle 41 are substantially identically shaped or are mirror images of one another, which feature would necessarily reduce the molding costs of the present invention. However, since upper magnet assembly 20 and lower magnet assembly 40 are constructed separately and then installed on site, it is further contemplated that upper magnet positioning cradle 21 and lower magnet positioning cradle 41 may be cooperatively keyed so as to insure correct magnet polarization during assembly. In this regard, the reader may wish to reference FIGS. 16 and 17 . It will be noted from an inspection of FIG. 16 that upper magnet positioning cradle 21 preferably comprises a downwardly extending cradle-positioning tooth or projection 75, which cradle-positioning tooth or projection 75 is cooperatively received in a tooth or projection-receiving slot 76 formed in lower magnet positioning cradle 41. Thus, the assembler, having an upper magnet assembly 20 and a lower magnet assembly 40 in hand (as evidenced by the differently formed magnet positioning cradles) may assemble the cradles around the fuel conduit or fuel line confident that the polarization of the magnet pairing will operate to direct a magnetic field through the fuel conduit.

It is further recognized that fuel lines or fuel conduits will differ from vehicle to vehicle or application to application and thus the outer diameter or outer periphery of a first fuel conduit application may vary from a second fuel conduit application. Thus, it is contemplated that proximal conduit-receiving upper grooves 33 and proximal conduit-receiving lower grooves 53 may have radii of curvature (or inner peripheries) that differ from one magnet positioning cradle to the next depending on the needs of the installer. FIG. 1, for example, generally illustrates a fuel treatment apparatus 10 comprising upper grooves 33 (not specifically referenced) and lower grooves 53 (not specifically referenced) that have a relatively small radii of curvature as compared to the radii of curvature of the upper grooves 33 and lower grooves 53 of the fuel treatment apparatus 10 depicted in FIG. 2. It is believed to be within the ordinary skill of those in art to provide varying radii of curvature as heretobefore described and thus further descriptions of the same are believed unnecessary.

Fuel treatment apparatus 10 as thus specified and described is designed for magnetically treating hydrocarbon fuel or similar other type fuel flowing through fuel conduit 100. While the above description contains much specificity, this specificity should not be construed as limitations on the scope of the invention, but rather as an exemplification of the invention. For example, while the preferred fastening means may be defined by a fastening assembly or fastener assembly as earlier described, it is further contemplated that the upper magnet member and the lower magnet member as seated upon the respective seat flanges may similarly function or operate to keep fuel treatment apparatus in assembled relation about a fuel conduit or fuel line. In this regard, it is contemplated that the attractive forces between the selected magnetically attractive pairing will operate to keep the upper magnet assembly and the lower magnet assembly in an assembled state about the fuel conduit. It is further contemplated that if the upper magnet member and the lower magnet member function to define the fastening means that the upper magnet cover plate and lower magnet cover plate could be omitted as necessary to the functionality of the fuel treatment apparatus of the present invention. Indeed, the upper magnet cover plate and the lower magnet cover plate may be omitted as necessary to the functionality of the present invention even if a screw assembly is utilized to define the fastening means. Upper and lower magnet cover plates 37 and 57 function not only to maintain the respective magnet members in seated engagement with the underlying or overlying magnet-positioning cradles, but further serve a magnet protecting, and, as earlier described, an appearance-enhancing function.

It is further contemplated that fuel treatment apparatus 10 need not be positioned such that upper magnet assembly 20 is oriented in a superior position relative to lower magnet assembly 40 as the term designations and illustrations might otherwise suggest. The reader will note that throughout the foregoing descriptions and corresponding figures that upper magnet assembly 20 has been described as assuming a superior position relative to lower magnet assembly 40. Indeed, upper magnet assembly 20 may very well be oriented in an inferior position relative to lower magnet assembly 40 or further, upper magnet assembly 20 and lower magnet assembly 40 might be oriented in a side by side relation. Given that in the preferred embodiment, conduit-receiving apertures are circular and fuel conduit has a correspondingly circular cross-section, fuel treatment apparatus 10 might be rotated about conduit axis 100 such that upper magnet assembly 20 might not actually be in the upper position. The reader will recall, however, that patent applicants, can be their own lexicographers and this regard, the upper magnet assembly 20 and lower magnet assembly 40 with their respective components have been designated as "upper" or "lower" simply for convenience as fuel treatment apparatus 10 comprises complicated structure. For example, it is contemplated that upper magnet assembly 20 could very easily have been referred to as the "first" magnet assembly and lower magnet assembly 40 could likewise have been referred to as the "second" magnet assembly so as to not draw attention to the spatial orientations of the same. However, use of the terms "first" and "second" was required elsewhere in the specifications and thus the applicants did not want to unnecessarily confuse the reader with overly repetitive language.

It is thus contemplated that the present invention essentially teaches a fuel treatment apparatus for magnetically treating fuel flowing through a fuel conduit. The fuel treatment apparatus essentially comprises an upper magnet assembly, a lower magnet assembly and select fastening means. The upper magnet assembly comprises an upper magnet positioning cradle and an upper magnet. The upper magnet positioning cradle comprises an upper frame, first and second upper frame seat flanges, and upper frame fastener means. The upper frame comprises a distal upper frame end, a proximal upper frame end, an interior upper frame surface, and an exterior upper frame surface. The upper frame seat flanges are integrally formed at the interior upper frame surface intermediate the distal upper end and the proximal upper end and are coplanar in an inferior magnet end plane. The upper frame fastener means are formed at the exterior upper frame surface and comprise proximal conduit-receiving upper grooves. The upper grooves each have a distally-extending upper frame conduit-receiving depth extending from the proximal upper frame end to the inferior magnet end plane. The upper magnet has a proximal upper magnet end and a distal upper magnet end and is designed for seatable engagement with the upper frame seat flanges.

The lower magnet assembly essentially comprises a lower magnet positioning cradle and a lower magnet. The lower magnet positioning cradle comprises a lower frame, first and second lower frame seat flanges, and lower frame fastener means. The lower frame comprises a distal lower frame end, a proximal lower frame end, an interior lower frame surface, and an exterior lower frame surface. The lower frame seat flanges are integrally formed at the interior lower frame surface intermediate the distal lower frame end and the proximal lower frame end and are coplanar in a superior magnet end plane. The lower frame fastener means are formed at the exterior lower frame surface and comprise proximal conduit-receiving lower grooves, the lower grooves each having a distally-extending lower frame conduit-receiving depth extending from the proximal lower frame end to the superior magnet end plane. The lower magnet has a proximal lower magnet end and a distal lower magnet end, the lower magnet being designed for seatable engagement with the lower frame seat flanges.

The select fastening means are designed to removably fasten the upper magnet assembly to the lower magnet assembly. When the upper magnet assembly is removably fastened to the lower magnet assembly, the upper grooves and the lower grooves cooperatively form conduit-receiving apertures. The fuel conduit, having a conduit axis, is receivable through the conduit-receiving apertures and thus the fuel treatment apparatus is designed to magnetically treat fuel flowing through the fuel conduit.

Accordingly, although the invention has been described by reference to a preferred embodiment with certain spatially descriptive language and the like, it is not intended that the novel assembly or apparatus be limited thereby, but that modifications thereof are intended to be included as falling within the broad scope and spirit of the foregoing disclosure, the following claims and the appended drawings.

We claim:

1. A fuel treatment system, the fuel treatment system comprising, in combination:

a fuel line assembly, the fuel line assembly comprising a fuel source, a fuel combustion chamber, and a fuel conduit, the fuel conduit being positioned intermediate the fuel source and the fuel combustion chamber for directing a flow of fuel from the fuel source to the fuel combustion chamber, the fuel conduit comprising a substantially linear conduit axis and an outer conduit diameter; and a fuel treatment apparatus for magnetically treating fuel flowing through the fuel conduit, the fuel treatment apparatus comprising an upper magnet assembly, a lower magnet assembly and fastening means for removably fastening the upper magnet assembly to the lower magnet assembly, the upper magnet assembly comprising an upper magnet positioning cradle and an upper magnet member, the upper magnet positioning cradle comprising a substantially rectangular upper frame, first and second upper frame seat flanges, and first and second upper frame fastener flanges, the upper frame comprising first and second upper frame end walls, first and second upper frame side walls, a distal upper frame end, a proximal upper frame end, an interior upper frame surface, and an exterior upper frame surface, the upper frame end walls each comprising two laterally-spaced upper frame markers, the upper frame seat flanges being integrally formed with the upper frame side walls at the interior upper frame surface extending from the first upper frame end wall to the second upper frame end wall to the upper frame markers intermediate the distal upper end and the proximal upper end, the upper frame seat flanges being coplanar in an inferior magnet end plane and defining a medially-aligned, substantially rectangular upper frame gap intermediate the upper frame markers, the upper frame fastener flanges being integrally formed with the upper frame end walls at the exterior upper frame surface extending from the first upper frame side wall to the second upper frame side wall, the upper frame fastener flanges each comprising a proximal conduit-receiving upper groove, the upper grooves each being semi-circular thus having a distally-extending upper frame radius of curvature extending from the proximal upper frame end to the inferior magnet end plane, the inferior magnet end plane being substantially tangential to the upper grooves, the upper magnet member having a proximal upper magnet end and a distal upper magnet end, the upper magnet member for seatable engagement with the upper frame seat flanges, the lower magnet assembly comprising a lower magnet positioning cradle and a lower magnet member, the lower magnet positioning cradle comprising a substantially rectangular lower frame, first and second lower frame seat flanges, and first and second lower frame fastener flanges, the lower frame comprising first and second lower frame end walls, first and second lower frame side walls, a distal lower frame end, a proximal lower frame end, an interior lower frame surface, and an exterior lower frame surface, the lower frame end walls each comprising two laterally-spaced lower frame markers, the lower frame seat flanges being integrally formed with the lower frame side walls at the interior lower frame surface extending from the first lower frame end wall to the second lower frame end wall to the lower frame markers intermediate the distal lower end and the proximal lower end, the lower frame seat flanges being coplanar in a superior magnet end plane and defining a medially-aligned, substantially rectangular lower frame gap intermediate the lower frame markers, the lower frame fastener flanges each comprising a proximal conduit-receiving lower groove, the lower grooves each being semi-circular thus having a distally-extending lower frame radius of curvature extending from the proximal lower frame end to the superior magnet end plane, the superior magnet end plane being substantially tangential to the lower grooves, the lower magnet member having a proximal lower magnet end and a distal lower magnet end, the lower magnet member for seatable engagement with the lower frame seat flanges, the upper grooves and the lower grooves cooperatively forming axially-aligned conduit-receiving apertures when the fastening means removably fasten the upper magnet assembly to the lower magnet assembly, the fuel conduit being receivable through the conduit-receiving apertures, the fuel treatment apparatus thus for magnetically treating fuel flowing through the fuel conduit.

2. The fuel treatment system of claim 1 wherein the upper magnet positioning cradle and the lower magnet positioning cradle are each sized and shaped to allow for free thermal expansion and contraction of the upper magnet member and the lower magnet member.

3. The fuel treatment system of claim 2 wherein the fuel treatment apparatus comprises an upper magnet cover plate and a lower magnet cover plate, the upper magnet cover plate being removably attachable to the distal upper frame end for maintaining the upper magnet member in seated engagement within the upper magnet positioning cradle, the lower magnet cover plate being removably attachable to the distal lower frame end for maintaining the lower magnet member in seated engagement within the lower magnet positioning cradle.

4. The fuel treatment system of claim 3 wherein the conduit-receiving apertures comprise select conduit-gripping means, the select conduit-gripping means for preventing the fuel treatment apparatus from moving relative to the conduit axis.

5. The fuel treatment system of claim 4 wherein the select conduit-gripping means are selected from the group consisting of friction-enhancing stop structure and conduit-receiving aperture sizing, the conduit-receiving aperture sizing being defined by a conduit-gripping diameter, the conduit-gripping diameter being substantially equal in magnitude to the outer conduit diameter for preventing the fuel treatment apparatus from moving relative to the conduit axis.

6. The fuel treatment system of claim 5 wherein the upper magnet positioning cradle, the lower magnet positioning cradle, the upper magnet cover plate, the lower magnet cover plate, and the friction-enhancing stop structure are constructed from nonmagnetic materials for maintaining the directed magnetic field.

7. The fuel treatment system of claim 1 wherein the upper magnet member and the lower magnet member together cooperatively form a magnetically-attractive pairing, the magnetically-attractive pairing being selected from a select magnet grouping, the select magnet grouping consisting of a first and second magnet orientation, the first magnet orientation being defined by the distal upper magnet end having an upper magnetic north pole, the proximal upper magnet end having an upper magnetic south pole, the distal lower magnet end having a lower magnetic south pole, and the proximal lower magnet end having a lower magnetic north pole, the second magnet orientation being defined by the distal upper magnet end having an upper magnetic south pole, the proximal upper magnet end having an upper magnetic north pole, the distal lower magnet end having a lower magnetic north pole, and the proximal lower magnet end having a lower magnetic south pole.

8. The fuel treatment system of claim 7 wherein the magnetically-attractive pairing has a directed magnetic field extending therethrough, the directed magnetic field being substantially uniformly orthogonal to the conduit axis.

9. A fuel treatment apparatus for magnetically treating fuel flowing through a fuel conduit, the fuel treatment apparatus comprising:

an upper magnet assembly, the upper magnet assembly comprising an upper magnet positioning cradle and an upper magnet member, the upper magnet positioning cradle comprising a substantially rectangular upper frame, first and second upper frame seat flanges, and first and second upper frame fastener flanges, the upper frame comprising first and second upper frame end walls, first and second upper frame side walls, a distal upper frame end, a proximal upper frame end, an interior upper frame surface, and an exterior upper frame surface, the upper frame end walls each comprising two laterally-spaced upper frame markers, the upper frame seat flanges being integrally formed with the upper frame side walls at the interior upper frame surface extending from the first upper frame end wall to the second upper frame end wall to the upper frame markers intermediate the distal upper end and the proximal upper end, the upper frame seat flanges being coplanar in an inferior magnet end plane and defining a medially-aligned, substantially rectangular upper frame gap intermediate the upper frame markers, the upper frame fastener flanges being integrally formed with the upper frame end walls at the exterior upper frame surface extending from the first upper frame side wall to the second upper frame side wall, the upper frame fastener flanges each comprising a proximal conduit-receiving upper groove and two upper frame fastener-receiving apertures, the upper frame fastener-receiving apertures being adjacent the first and second upper frame side walls, the upper grooves each being semi-circular thus having a distally-extending upper frame radius of curvature extending from the proximal upper frame end to the inferior magnet end plane, the inferior magnet end plane being substantially tangential to the upper grooves, the upper magnet member having a proximal upper magnet end and a distal upper magnet end, the upper magnet member for seatable engagement with the upper frame seat flanges;

a lower magnet assembly, the lower magnet assembly comprising a lower magnet positioning cradle and a lower magnet member, the lower magnet positioning cradle comprising a substantially rectangular lower frame, first and second lower frame seat flanges, and first and second lower frame fastener flanges, the lower frame comprising first and second lower frame end walls, first and second lower frame side walls, a distal lower frame end, a proximal lower frame end, an interior lower frame surface, and an exterior lower frame surface, the lower frame end walls each comprising two laterally-spaced lower frame markers, the lower frame seat flanges being integrally formed with the lower frame side walls at the interior lower frame surface extending from the first lower frame end wall to the second lower frame end wall to the lower frame markers intermediate the distal lower end and the proximal lower end, the lower frame seat flanges being coplanar in a superior magnet end plane and defining a medially-aligned, substantially rectangular lower frame gap intermediate the lower frame markers, the lower frame fastener flanges being integrally formed with the lower frame end walls at the exterior lower frame surface extending from the first lower frame side wall to the second lower frame side wall, the lower frame fastener flanges each comprising a proximal conduit-receiving lower groove and two lower frame fastener-receiving apertures, the lower frame fastener-receiving apertures being adjacent the first and second lower frame side walls, the lower grooves each being semi-circular thus having a distally-extending lower frame radius of curvature extending from the proximal lower frame end to the superior magnet end plane, the superior magnet end plane being substantially tangential to the lower grooves, the lower magnet member having a proximal lower magnet end and a distal lower magnet end, the lower magnet member for seatable engagement with the lower frame seat flanges; and a fastening assembly for fastening the upper magnet assembly to the lower magnet assembly, the fastening assembly comprising two first end screws and two second end screws, the upper frame fastener-receiving apertures and the lower frame fastener-receiving apertures cooperatively forming two substantially parallel first end screw-receiving tunnels and two substantially parallel second end screw-receiving tunnels, the tunnels each having a screw-receiving axis substantially orthogonal to the inferior and superior magnet end planes, the fuel conduit having a substantially linear conduit axis and an outer conduit diameter, the upper grooves and the lower grooves cooperatively forming axially-aligned conduit-receiving apertures when the screws fasten the upper magnet assembly to the lower magnet assembly via the screw-receiving tunnels, the fuel conduit being receivable through the conduit-receiving apertures, the fuel treatment apparatus thus for magnetically treating fuel flowing through the fuel conduit.

10. The fuel treatment apparatus of claim 9 wherein the upper magnet member and the lower magnet member together cooperatively form a magnetically-attractive pairing, the magnetically-attractive pairing being selected from a select magnet grouping, the select magnet grouping consisting of a first and second magnet orientation, the first magnet orientation being defined by the distal upper magnet end having an upper magnetic north pole, the proximal upper magnet end having an upper magnetic south pole, the distal lower magnet end having a lower magnetic south pole, and the proximal lower magnet end having a lower magnetic north pole, the second magnet orientation being defined by the distal upper magnet end having an upper magnetic south pole, the proximal upper magnet end having an upper magnetic north pole, the distal lower magnet end having a lower magnetic north pole, and the proximal lower magnet end having a lower magnetic south pole.

11. The fuel treatment apparatus of claim 10 wherein the magnetically-attractive pairing has a directed magnetic field extending therethrough, the directed magnetic field being substantially uniformly orthogonal to the conduit axis.

12. The fuel treatment apparatus of claim 11 wherein the upper magnet positioning cradle and the lower magnet positioning cradle are sized and shaped to allow for free thermal expansion and contraction of the upper magnet member and the lower magnet member.

13. The fuel treatment apparatus of claim 12 wherein the fuel treatment apparatus comprises an upper magnet cover plate and a lower magnet cover plate, the upper magnet cover plate being removably attachable to the distal upper frame end for maintaining the upper magnet member in seated engagement within the upper magnet positioning cradle, the lower magnet cover plate being removably attachable to the distal lower frame end for maintaining the lower magnet member in seated engagement within the lower magnet positioning cradle.

14. The fuel treatment apparatus of claim 13 wherein the lower frame fastener-receiving apertures each comprise threaded insert members for enhancing fastening engagement of the upper magnet assembly to the lower magnet assembly.

15. The fuel treatment apparatus of claim 14 wherein the conduit-receiving apertures comprise select fuel conduit-gripping means, the select fuel conduit-gripping means for preventing the fuel treatment apparatus from moving relative to the conduit axis.

16. The fuel treatment apparatus of claim 15 wherein the select conduit-gripping means are selected from the group consisting of friction-enhancing stop structure and conduit-receiving aperture sizing, the conduit-receiving aperture sizing being defined by a conduit-gripping diameter, the conduit-gripping diameter being substantially equal in magnitude to the outer conduit diameter for preventing the fuel treatment apparatus from moving relative to the conduit axis.

17. The fuel treatment apparatus of claim 16 wherein the upper magnet positioning cradle, the lower magnet positioning cradle, the upper magnet cover plate, the lower magnet cover plate, the fastening means, the friction-enhancing stop structure, and the threaded insert members are constructed from nonmagnetic materials for maintaining the directed magnetic field.

18. A fuel treatment apparatus for magnetically treating fuel flowing through a fuel conduit, the fuel treatment apparatus comprising:

an upper magnet assembly, the upper magnet assembly comprising an upper magnet positioning cradle and an upper magnet member, the upper magnet positioning cradle comprising a substantially rectangular upper frame, first and second upper frame seat flanges, and first and second upper frame fastener flanges, the upper frame comprising first and second upper frame end walls, first and second upper frame side walls, a distal upper frame end, a proximal upper frame end, an interior upper frame surface, and an exterior upper frame surface, the upper frame seat flanges being integrally formed with the upper frame side walls at the interior upper frame surface extending from the first end wall to the second end wall intermediate the distal upper end and the proximal upper end, the upper frame seat flanges being coplanar in an inferior magnet end plane, the upper frame fastener flanges being integrally formed with the upper frame end walls at the exterior upper frame surface extending from the first upper frame side wall to the second upper frame side wall, the upper frame fastener flanges each comprising a proximal conduit-receiving upper groove, the upper grooves each being semi-circular thus having a distally-extending upper frame radius of curvature extending from the proximal upper frame end to the inferior magnet end plane, the inferior magnet end plane being substantially tangential to the upper grooves, the upper magnet member having a proximal upper magnet end and a distal upper magnet end, the upper magnet member for seatable engagement with the upper frame seat flanges;

a lower magnet assembly, the lower magnet assembly comprising a lower magnet positioning cradle and a lower magnet member, the lower magnet positioning cradle comprising a substantially rectangular lower frame, first and second lower frame seat flanges, and first and second lower frame fastener flanges, the lower frame comprising first and second lower frame end walls, first and second lower frame side walls, a distal lower frame end, a proximal lower frame end, an interior lower frame surface, and an exterior lower frame surface, the lower frame seat flanges being integrally formed with the lower frame side walls at the interior lower frame surface extending from the first lower frame end wall to the second lower frame end wall intermediate the distal lower frame end and the proximal lower frame end, the lower frame seat flanges being coplanar in a superior magnet end plane, the lower frame fastener flanges being integrally formed with the lower frame end walls at the exterior lower frame surface extending from the first lower frame side wall to the second lower frame side wall, the lower frame fastener flanges each comprising a proximal conduit-receiving lower groove, the lower grooves each being semi-circular thus having a distally-extending lower frame radius of curvature extending from the proximal lower frame end to the superior magnet end plane, the superior magnet end plane being substantially tangential to the lower grooves, the lower magnet member having a proximal lower magnet end and a distal lower magnet end, the lower magnet member for seatable engagement with the lower frame seat flanges; and fastening means for removably fastening the upper magnet assembly to the lower magnet assembly, the upper grooves and the lower grooves cooperatively forming axially aligned conduit-receiving apertures when fastened together, the fuel conduit having a substantially linear conduit axis and an outer conduit diameter, the fuel conduit being receivable through the conduit-receiving apertures, the fuel treatment apparatus thus for magnetically treating fuel flowing through the fuel conduit.

19. The fuel treatment apparatus of claim 18 wherein the upper magnet member and the lower magnet member together cooperatively form a magnetically-attractive pairing, the magnetically-attractive pairing being selected from a select magnet grouping, the select magnet grouping consisting of a first and second magnet orientation, the first magnet orientation being defined by the distal upper magnet end having an upper magnetic north pole, the proximal upper magnet end having an upper magnetic south pole, the distal lower magnet end having a lower magnetic south pole, and the proximal lower magnet end having a lower magnetic north pole, the second magnet orientation being defined by the distal upper magnet end having an upper magnetic south pole, the proximal upper magnet end having an upper magnetic north pole, the distal lower magnet end having a lower magnetic north pole, and the proximal lower magnet end having a lower magnetic south pole.

20. The fuel treatment apparatus of claim 19 wherein the magnetically-attractive pairing has a directed magnetic field extending therethrough, the directed magnetic field being substantially orthogonal to the conduit axis.

21. The fuel treatment apparatus of claim 20 wherein the upper magnet positioning cradle and the lower magnet positioning cradle are sized and shaped to allow for free thermal expansion and contraction of the upper magnet member and the lower magnet member.

22. The fuel treatment apparatus of claim 21 wherein the fuel treatment apparatus comprises an upper magnet cover plate and a lower magnet cover plate, the upper magnet cover plate being removably attachable to the distal upper frame end for maintaining the upper magnet member in seated engagement within the upper magnet positioning cradle, the lower magnet cover plate being removably attachable to the distal lower frame end for maintaining the lower magnet member in seated engagement within the lower magnet positioning cradle.

23. The fuel treatment apparatus of claim 22 wherein the conduit-receiving apertures comprise select conduit-gripping means, the select conduit-gripping means for preventing the fuel treatment apparatus from moving relative to the conduit axis.

24. The fuel treatment apparatus of claim 23 wherein the select conduit-gripping means are selected from the group consisting of friction-enhancing stop structure and conduit-receiving aperture sizing, the conduit-receiving aperture sizing being defined by a conduit-engaging diameter, the conduit-engaging diameter being substantially equal in magnitude to the outer conduit diameter for preventing the fuel treatment apparatus from moving relative to the conduit axis.

25. The fuel treatment apparatus of claim 24 wherein the upper magnet positioning cradle, the lower magnet positioning cradle, the upper magnet cover plate, the lower magnet cover plate, and the friction-enhancing stop structure are constructed from nonmagnetic materials for maintaining the directed magnetic field.

26. The fuel treatment apparatus of claim 20 wherein the upper and lower frame end walls each comprise two laterally-spaced frame markers, the upper and lower frame seat flanges extending medially to the frame markers, the upper and lower frame seat flanges thus defining a medially-aligned upper frame gap and a medially-aligned lower frame gap, the upper and lower frame gaps being located intermediate the frame markers for maintaining the directed magnetic field.

27. A fuel treatment apparatus for magnetically treating fuel flowing through a fuel conduit, the fuel treatment apparatus comprising:

an upper magnet assembly, the upper magnet assembly comprising an upper magnet positioning cradle and an upper magnet, the upper magnet positioning cradle comprising an upper frame, first and second upper frame seat flanges, and upper frame fastener means, the upper frame comprising a distal upper frame end, a proximal upper frame end, an interior upper frame surface, and an exterior upper frame surface, the upper frame seat flanges being integrally formed at the interior upper frame surface intermediate the distal upper end and the proximal upper end, the upper frame seat flanges being coplanar in an inferior magnet end plane, the upper frame fastener means being formed at the exterior upper frame surface, the upper frame fastener means comprising proximal conduit-receiving upper grooves, the upper grooves each having a distally-extending upper frame conduit-receiving depth extending from the proximal upper frame end to the inferior magnet end plane, the upper magnet having a proximal upper magnet end and a distal upper magnet end, the upper magnet for seatable engagement with the upper frame seat flanges; and a lower magnet assembly, the lower magnet assembly comprising a lower magnet positioning cradle and a lower magnet, the lower magnet positioning cradle comprising a lower frame, first and second lower frame seat flanges, and lower frame fastener means, the lower frame comprising a distal lower frame end, a proximal lower frame end, an interior lower frame surface, and an exterior lower frame surface, the lower frame seat flanges being integrally formed at the interior lower frame surface intermediate the distal lower frame end and the proximal lower frame end, the lower frame seat flanges being coplanar in a superior magnet end plane, the lower frame fastener means being formed at the exterior lower frame surface, the lower frame fastener means comprising proximal conduit-receiving lower grooves, the lower grooves each having a distally-extending lower frame conduit-receiving depth extending from the proximal lower frame end to the superior magnet end plane, the lower magnet having a proximal lower magnet end and a distal lower magnet end, the lower magnet for seatable engagement with the lower frame seat flanges; and select fastening means for removably fastening the upper magnet assembly to the lower magnet assembly, the upper grooves and the lower grooves cooperatively forming conduit-receiving apertures, the fuel conduit having a conduit axis and being receivable through the conduit-receiving apertures, the fuel treatment apparatus thus for magnetically treating fuel flowing through the fuel conduit.

28. The fuel treatment apparatus of claim 27 wherein the upper magnet and the lower magnet together cooperatively form a magnetically-attractive pairing, the magnetically-attractive pairing being selected from a select magnet grouping, the select magnet grouping consisting of a first and second magnet orientation, the first magnet orientation being defined by the distal upper magnet end having an upper magnetic north pole, the proximal upper magnet end having an upper magnetic south pole, the distal lower magnet end having a lower magnetic south pole, and the proximal lower magnet end having a lower magnetic north pole, the second magnet orientation being defined by the distal upper magnet end having an upper magnetic south pole, the proximal upper magnet end having an upper magnetic north pole, the distal lower magnet end having a lower magnetic north pole, and the proximal lower magnet end having a lower magnetic south pole.

29. The fuel treatment apparatus of claim 28 wherein the magnetically-attractive pairing has a directed magnetic field extending therethrough, the directed magnetic field being substantially orthogonal to the conduit axis.

30. The fuel treatment apparatus of claim 29 wherein the fuel treatment apparatus comprises an upper magnet cover plate and a lower magnet cover plate, the upper magnet cover plate being removably attachable to the distal upper frame end for maintaining the upper magnet in seated engagement within the upper magnet positioning cradle, the lower magnet cover plate being removably attachable to the distal lower frame end for maintaining the lower magnet in seated engagement within the lower magnet positioning cradle.

31. The fuel treatment apparatus of claim 30 wherein the upper magnet-positioning cradle and the lower magnet-positioning cradle are sized and shaped to allow for free thermal expansion and contraction of the upper magnet and the lower magnet.

32. The fuel treatment apparatus of claim 31 wherein the conduit-receiving apertures comprise select conduit-gripping means, the select conduit-gripping means for preventing the fuel treatment apparatus from moving relative to the conduit axis.

33. The fuel treatment apparatus of claim 32, wherein the select conduit-gripping means are selected from the group consisting of friction-enhancing stop structure and conduit-receiving aperture sizing, the conduit-receiving aperture sizing being defined by a conduit-engaging diameter, the conduit-engaging diameter being substantially equal in magnitude to the outer conduit diameter for preventing the fuel treatment apparatus from moving relative to the conduit axis.

34. The fuel treatment apparatus of claim 33 wherein the upper magnet positioning cradle, the lower magnet positioning cradle, the upper magnet cover plate, the lower magnet cover plate, and the friction-enhancing stop structure are constructed from nonmagnetic materials for enhancing the directed magnetic field.

35. The fuel treatment apparatus of claim 28 wherein the select fastening means are selected from the group consisting of a fastener assembly and the select magnet grouping.

36. The fuel treatment apparatus of claim 29 wherein upper lower magnet-positioning cradles each comprise two laterally-spaced frame markers, the upper and lower frame seat flanges extending medially to the frame markers, the upper and lower frame seat flanges thus defining a medially-aligned upper frame gap and a medially-aligned lower frame gap, the upper and lower frame gaps being located intermediate the frame markers for maintaining the directed magnetic field.

* * * * *

UNITED STATES PATENT AND TRADEMARK OFFICE

CERTIFICATE OF CORRECTION

PATENT NO. : 6,890,432 B1
DATED : May 10, 2005
INVENTOR(S) : John T. Witz and Albert F. Ditzig It is certified that error appears in the above-identified patent and that said Letters Patent is hereby corrected as shown below:

Column 5,
Line 62, "10" should be -- 110 --.

Column 10,
Line 2, "01" should be -- 101 --.

Signed and Sealed this

Fourth Day of October, 2005

JON W. DUDAS
*Director of the United States Patent and Trademark Office*